US008568135B2

(12) United States Patent
Dickie

(10) Patent No.: US 8,568,135 B2
(45) Date of Patent: Oct. 29, 2013

(54) DEVICE FOR LIGHTING AND EXTINGUISHING CANDLES

(75) Inventor: Robert G. Dickie, King City (CA)

(73) Assignee: 2268447 Ontario Inc, King City (CA)

( * ) Notice: Subject to any disclaimer, the term of this patent is extended or adjusted under 35 U.S.C. 154(b) by 645 days.

(21) Appl. No.: 12/781,342

(22) Filed: May 17, 2010

(65) Prior Publication Data

US 2011/0281224 A1 Nov. 17, 2011

(51) Int. Cl.
*F23Q 2/00* (2006.01)
*F23Q 25/00* (2006.01)

(52) U.S. Cl.
USPC ..... 431/143; 431/146; 431/149

(58) Field of Classification Search
USPC ..... 431/143, 146, 149
See application file for complete search history.

(56) References Cited

U.S. PATENT DOCUMENTS

| | | | | |
|---|---|---|---|---|
| 940,832 | A | 11/1909 | Swoger | |
| 1,740,623 | A | 12/1929 | Payne | |
| 2,785,556 | A | 3/1957 | Smith | |
| 3,339,812 | A * | 9/1967 | Meissner | 222/566 |
| 3,985,492 | A | 10/1976 | Nunemaker | |
| D330,784 | S | 11/1992 | Zuffoletti | |
| 5,282,737 | A | 2/1994 | Ray | |
| 5,344,309 | A | 9/1994 | Phare | |
| 6,435,858 | B1 | 8/2002 | Cormier et al. | |
| 6,929,466 | B1 | 8/2005 | Reese | |
| 7,497,683 | B2 | 3/2009 | Benson | |
| 2005/0032011 | A1 | 2/2005 | Chapman | |
| 2005/0287486 | A1 | 12/2005 | Yates et al. | |
| 2007/0122758 | A1 * | 5/2007 | Bloomfield | 431/153 |
| 2007/0231756 | A1 | 10/2007 | Valentine | |

FOREIGN PATENT DOCUMENTS

| | | |
|---|---|---|
| DE | 102009050591 | 4/2011 |
| GB | 191323610 | 9/1914 |
| GB | 2349686 | 11/2000 |

* cited by examiner

*Primary Examiner* — Kenneth Rinehart
*Assistant Examiner* — William Corboy
(74) *Attorney, Agent, or Firm* — Sand & Sebolt

(57) ABSTRACT

A device for lighting and extinguishing candles that includes a housing, an ignitor mechanism provided on the housing, an extinguisher mechanism provided on the housing and being movable between a retracted position and an extended position, and a first actuator for the extinguisher mechanism. Activation of the first actuator prevents the ignitor mechanism from being operated.

16 Claims, 26 Drawing Sheets

DEVICE FOR LIGHTING AND EXTINGUISHING CANDLES

TECHNICAL FIELD

This invention generally relates to lighters. More particularly, the invention relates to a device that is able to light and to extinguish candles. Specifically, the invention relates to a combined device that includes an igniter mechanism, an extinguisher mechanism that is retractable and extendable, and an actuator for the extinguisher mechanism that, when activated, prevents the ignitor mechanism from being operated.

BACKGROUND INFORMATION

Over the years, people have lit candles in a number of ways including the use of tapers and matches. Traditional style candles are not very hard to light as one may simply hold a match to the side of the wick. Jar type candles, on the other hand, have wicks which are recessed below the rim of the jar and are difficult to light using a regular match as one can burn ones' fingers doing so. Long fireplace style matches may be used to light this type of candle but these matches are expensive and can leave small pieces of burned wood or carbon in the candle wax. Jar type candles are more easily and safely ignited by using a butane lighter having an elongated flame proof barrel made from metal.

Hundreds of years ago, castles and other buildings had large wall-mounted candles for illumination and not so long ago, most towns had kerosene street lamps. These were regularly lit and extinguished using long sticks that could retain a burning taper to light the candle or lamp and included an extinguishing cap to snuff out the flame.

A number of other devices are known in the art for both igniting a candle flame and extinguishing the same. For example, U.S. Pat. No. 1,740,623 to Payne discloses a device which includes a candle lighter and an extinguisher. The device has a telescoping handle that includes a region through which a taper is threaded. A mechanism is provided for feeding the taper through the tube. The device further includes a bell-shaped region that is placed over the end of the candle to extinguish the burning wick.

U.S. Pat. No. 2,785,556 to Smith discloses a device that is used for lighting and extinguishing altar candles. The device includes a tube through which a taper is threaded and a support having a bell at one end for extinguishing a flame. A second tube extends through the support from the bell to a container used to hold a quantity of a flammable liquid, such as lighter fluid. The user depresses a trigger to release a valve and thereby permit a specified quantity of the flammable liquid to flow through the second tube from the container to the bell region. The bell is positioned over the candle wick and the flammable liquid fluid is dispensed thereover. When the trigger is released, the flow of liquid is halted. The device is partially rotated and the taper is used to light the candle. Later, the bell may be used to extinguish the candle. In one embodiment of the invention, shown in FIGS. 6-9, when the mechanism for dispensing flammable liquid over the candle wick is released, it actuates a second mechanism which ignites the liquid on the wick. Because of the structure of the igniting mechanism, the bell cannot be provided adjacent the tube that dispenses the flammable liquid. Instead, a second container is provided that holds a quantity of compressed carbon dioxide or other similar gas. A third tube connects the second container to the support and a separate actuator is used to dispense the carbon dioxide to extinguish a flame.

U.S. Pat. No. 3,985,492 to Nunemaker discloses a device having a straight shaft with a candle extinguisher at one end and a holder for a safety match at the other end. The extinguisher is, once again, a bell-shaped region that is placed over the top of the candle. The device is rotated to use the two different elements.

U.S. Pat. No. 5,344,309 to Phare discloses a generally Y-shaped shaft with a bell type extinguisher on a first arm of the Y and a member for holding a taper on the second arm thereof. The device further includes a squeeze bulb at the other end of the shaft for directing air into the second arm.

U.S. Pat. No. 6,929,466 to Reese, discloses a butane type lighter having an elongated flame proof barrel that is used to light a candle. The barrel is extendable in length. The lighter includes a pivotable bell-shaped region at the opposite end of the device from the barrel. The bell-shaped region is, once again, used to extinguish flames. One of the issues with this lighter is that the bell-shaped extinguisher is positioned adjacent the container of fuel. The user has to place the fuel-filled container next to the burning flame in order to extinguish the same. Obviously, this creates a safety issue for the user.

U.S. Pat. No. 7,497,683 to Benson discloses a device that has a candle lighting area at one end and a candle extinguishing area at the other end. The lighting area includes a pair of cooperating jaws that are used to clamp a safety match therein between. The extinguishing area once again comprises a bell-shaped region that is placed over the end of the candle to deprive the burning wick of oxygen.

U.S. Design Pat. No. D330,784 to Zuffoletti shows a lighter having an elongated, generally Y-shaped shaft with a bell-shaped extinguisher on one arm and a region for lighting a candle on the other arm. The shaft extends outwardly from a body that presumably contains a fuel source. When a candle is to be lit, a trigger is depressed to allow fuel to flow to the region for lighting the candle. The device is rotated to permit the bell-shaped region to be positioned on the top of a candle to extinguish a burning wick.

There are devices other than bell-shaped members known in the art for extinguishing burning candle wicks. A number of these other devices include two opposing plates that are moved toward each other to clamp a burning wick between them and thereby extinguish the flame. A first one of these snuffer type devices is disclosed in U.S. Pat. No. 940,832 to Swoger. Swoger discloses an elongated handle with two plate-like surfaces pivotally mounted at one end of the handle. The plates are biased by a spring into a position where they are separated from each other. A string connected to the plates is pulled downwardly to move the plates toward each other. The user positions the plates on either side of a burning candle wick and pulls on the string so that the plates clamp the burning wick between them and thereby extinguishes the flame.

U.S. Pat. No. 5,282,737 to Ray discloses a tong type member that includes two opposing faces that may be moved toward each other to clamp a burning wick between them. The faces are provided with surfaces that may be wetted so as to more quickly and easily snuff out a burning wick.

U.S. Pat. No. 6,435,858 to Cormier et al discloses a tong type snuffer having two faces that are simply brought toward each other to clamp a burning wick between them.

U.S. Publication 2005/0032011 to Chapman discloses a combination lighter and snuffer where the snuffer includes a tong type device that is similar to that disclosed by Cormier above. The device also includes a holder that is shaped to receive a disposable lighter therein. The lighter holder is at the opposite end of the device from the snuffer. The lighter holder includes a mechanism for retaining the lighter within the holder. It is unclear from the patent if the lighter is removed from the holder to light a candle or if the lighter is ignited while still in the holder.

U.S. Publication No. 2005/0287486 to Yates et al discloses tongs that have cup-like chambers on opposing jaws of the tongs. The jaws are brought together to enclose the chambers about the burning wick to deprive the same of oxygen and thereby extinguish the flame.

Matches are currently used less frequently to light fires, barbeques or candles than in previous times. Instead, the most popular type of device used as a lighter is one that has a body with a chamber containing butane gas, an elongated flame proof barrel extending outwardly from the body and a trigger type mechanism for dispensing and igniting fuel flowing out of the chamber. These lighters are favored because the flame proof barrel allows the person to position their hand a remote distance from the materials being ignited. The lighters are thus safer to use than smaller tubular type lighters. As the patent to Reese (U.S. Pat. No. 6,929,466) has disclosed, it is known to provide elongated barrel lighters with some type of extinguisher. However, the present inventor has recognized that the positioning of the extinguisher on the Reese lighter creates a safety hazard in that the extinguisher is disposed adjacent the fuel source. Simply positioning the extinguisher on the barrel creates two issues. Firstly, the extinguisher could prevent the barrel from being inserted into confined spaces, such as into the interior of a jar-type candle. Secondly, if the extinguisher is positioned so that the barrel can be inserted into confined spaces, the extinguisher itself could interfere with the flame produced by the barrel and could therefore render the device less useful.

There is therefore a need in the art for an improved device that enables a person to light and to extinguish a candle, where the extinguisher on the device is positioned away from a fuel source on the device but still enables the barrel to be inserted into confined spaces without interfering with the flame produced by the device.

SUMMARY OF THE INVENTION

The device of the present invention is used for lighting and extinguishing candles. The device includes a housing, an ignitor mechanism provided on the housing, an extinguisher mechanism provided on the housing that is movable between a retracted position and an extended position, and a first actuator for the extinguisher mechanism. Activation of the first actuator prevents the ignitor mechanism from being operated.

In a first preferred embodiment of the invention, the extinguisher mechanism includes a snuffer apparatus and an extinguisher trigger for activating the same. The snuffer apparatus includes a pair of spring-biased, burn-proof paddles that are brought together to clamp a burning candle wick between them and thereby extinguish the flame. When the paddles are not in use, they are moved into a retracted position where they are disposed inwardly of a terminal end of the flame-emitting barrel of the lighter. When the paddles are to be used to extinguish a flame, they are moved to an extended position where they are disposed in front of the terminal end of the barrel. When activated to move the paddles into their extended position, the extinguisher trigger physically obstructs access to the igniter trigger and thereby prevents the device from accidentally producing a flame. In this first embodiment of the invention, the extinguisher trigger is rotated to activate the snuffer mechanism.

In a second preferred embodiment of the invention, the extinguisher mechanism again includes a snuffer apparatus and an extinguisher trigger. The snuffer apparatus includes a pair of paddles that are pivotally mounted onto a surface of the barrel. The paddles include arms that are moved from a first position where they extend rearwardly along the barrel from the flame-emitting end to a second position where they extend forwardly along the barrel and beyond the end. The paddle arms have opposed faces that clamp a burning wick between them. Once again the extinguisher trigger is rotated to activate the snuffer mechanism.

In a third preferred embodiment of the invention, the extinguisher mechanism again includes a snuffer apparatus and an extinguisher trigger. The snuffer apparatus is substantially the same as the snuffer apparatus of the first embodiment. The extinguisher mechanism in this instance includes a trigger that has a cable-type mechanism that drives the snuffer apparatus.

In a fourth preferred embodiment of the invention, the extinguisher mechanism again includes a snuffer apparatus and an extinguisher trigger. The snuffer apparatus is substantially the same as the snuffer apparatus of the first embodiment. The extinguisher mechanism in this instance includes a trigger that has a gear-type mechanism that drives the snuffer apparatus.

In all of the embodiments the paddles are spring-biased into the retracted position.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Referring to FIGS. 1-15, there is shown a candle lighting and extinguishing device in accordance with the present invention and generally indicated at 10. Device 10 has the general appearance of a butane lighter currently popular for lighting barbeques, but device 10 includes a number of components that are not present on these currently known barbeque lighters.

Figure 1:
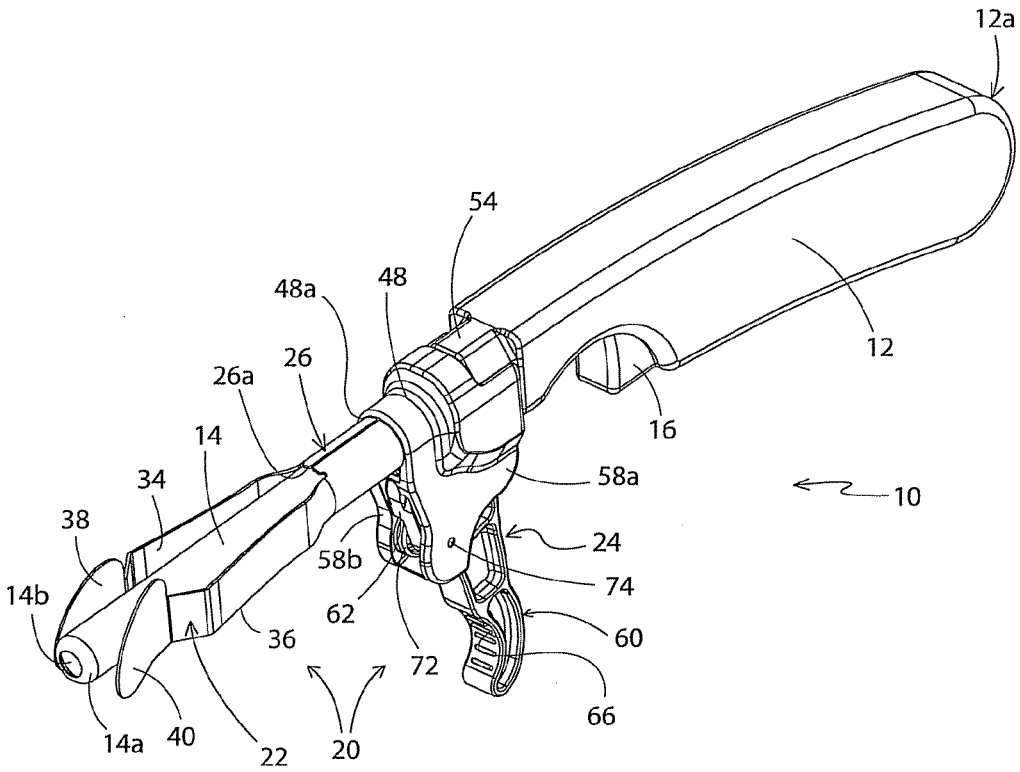
FIG. 1 is a front perspective view of a combined ignitor extinguisher device in accordance with the present invention showing a first embodiment of an extinguisher mechanism provided thereon.
Figure 2:
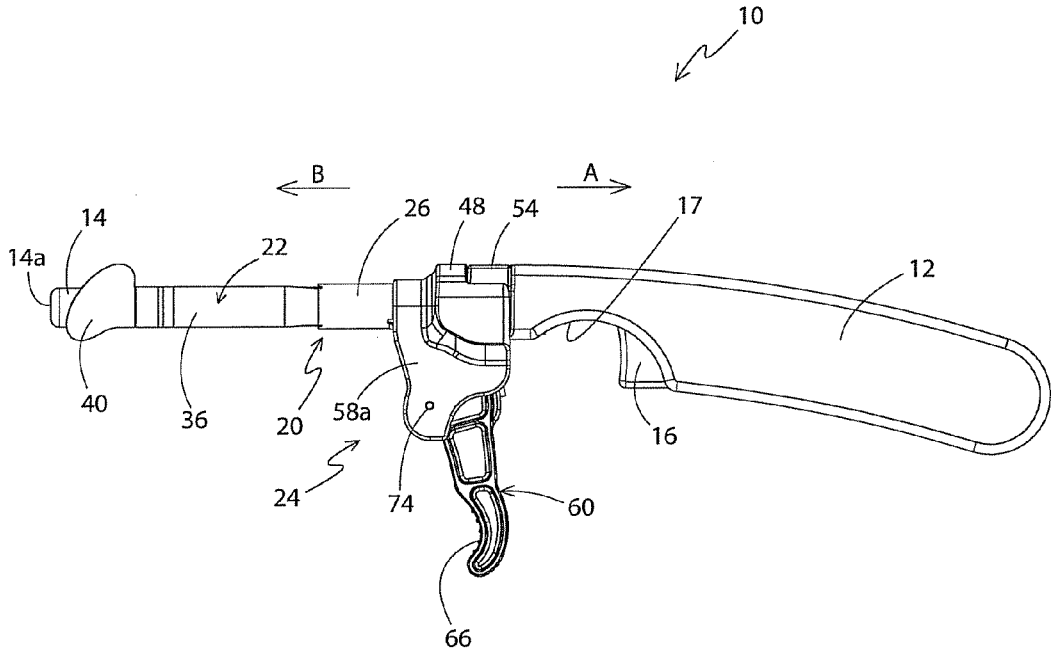
FIG. 2 is a left side view of the device of FIG. 1 showing the arms of the snuffer apparatus of the extinguisher mechanism positioned rearwardly of the flame-emitting end of the device and therefore in a position where the device may be used to produce a flame to ignite a candle wick.
Figure 11:
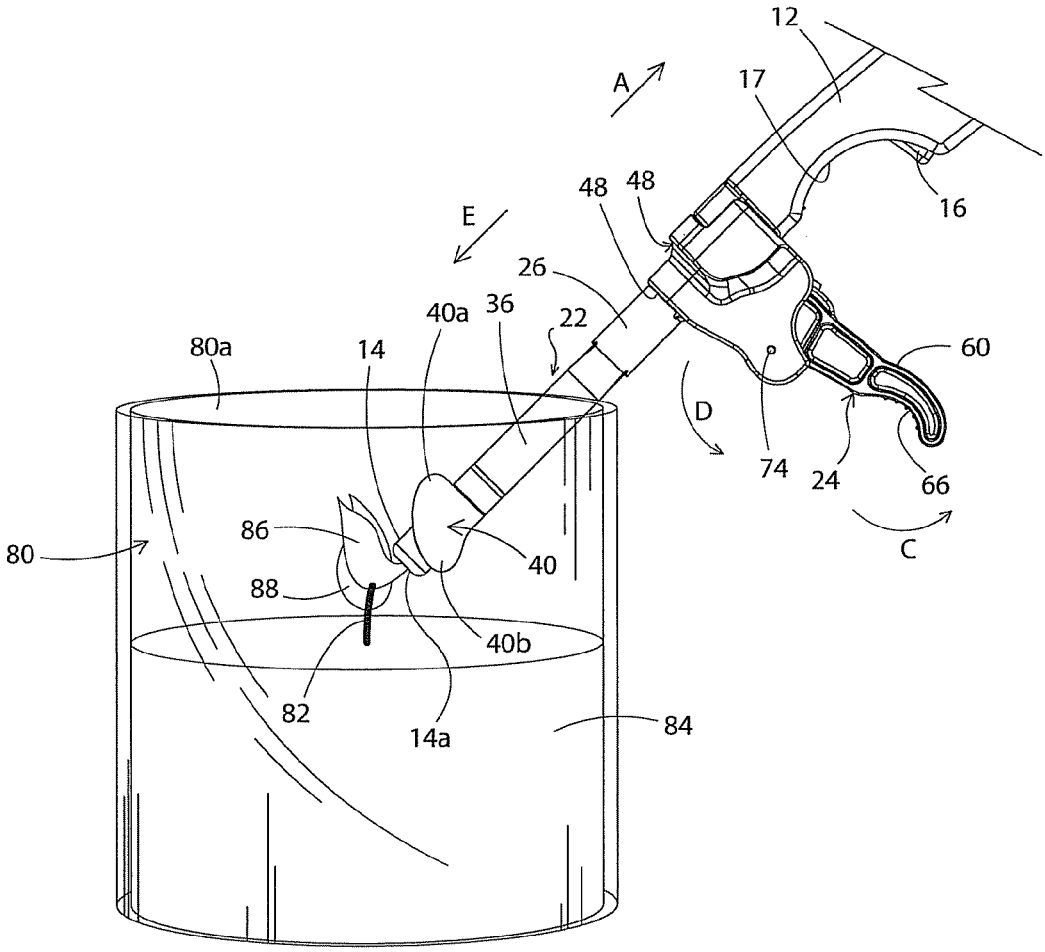
FIG. 11 is a front perspective view showing the device being used to light a candle in a candle jar and showing the snuffer apparatus in the first position and the extinguisher in the at rest position, and showing the igniter trigger in the activated position.
Figure 12:
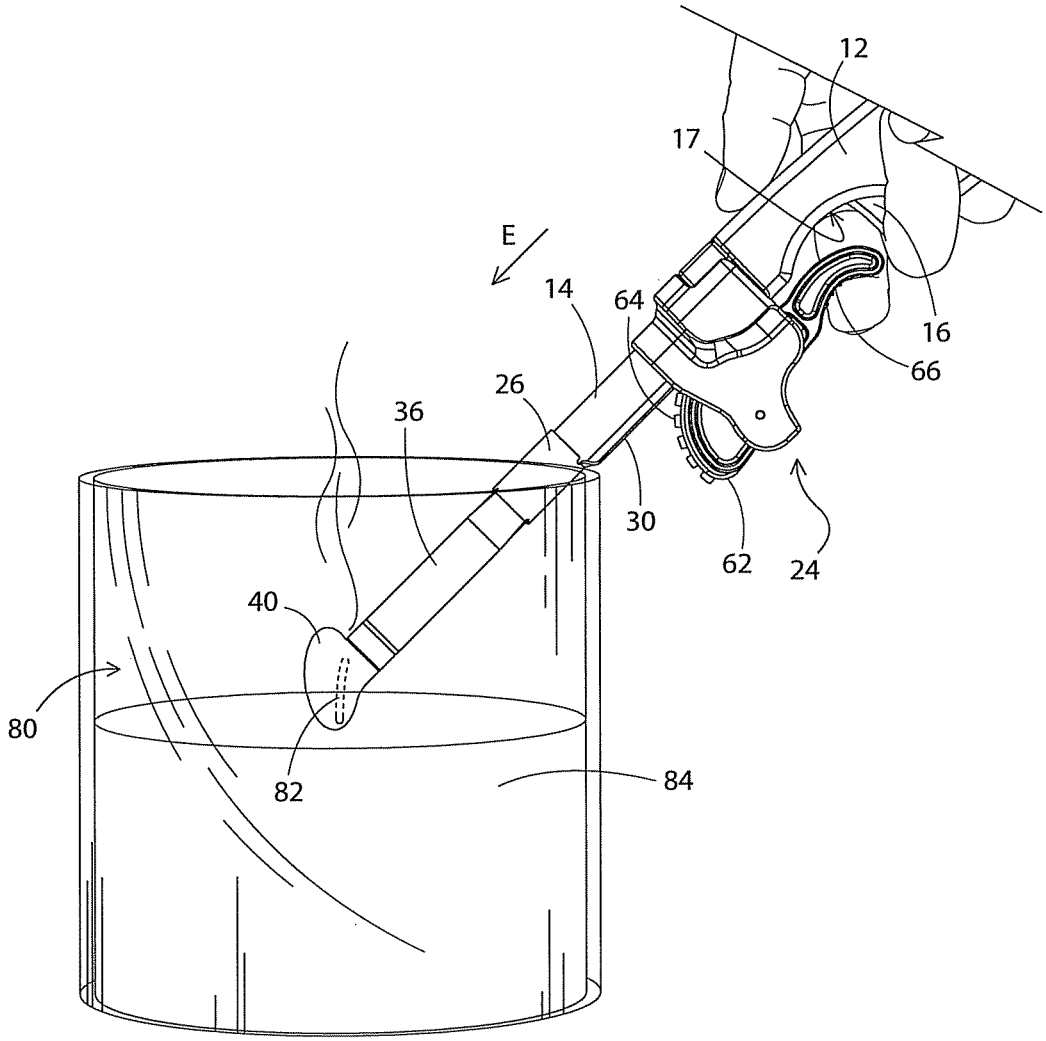
FIG. 12 is a front perspective view showing the device extinguishing a burning wick and showing the snuffer apparatus in the second position and the extinguisher trigger in an activated position where it interferes with access to the igniter trigger.
Figure 13:
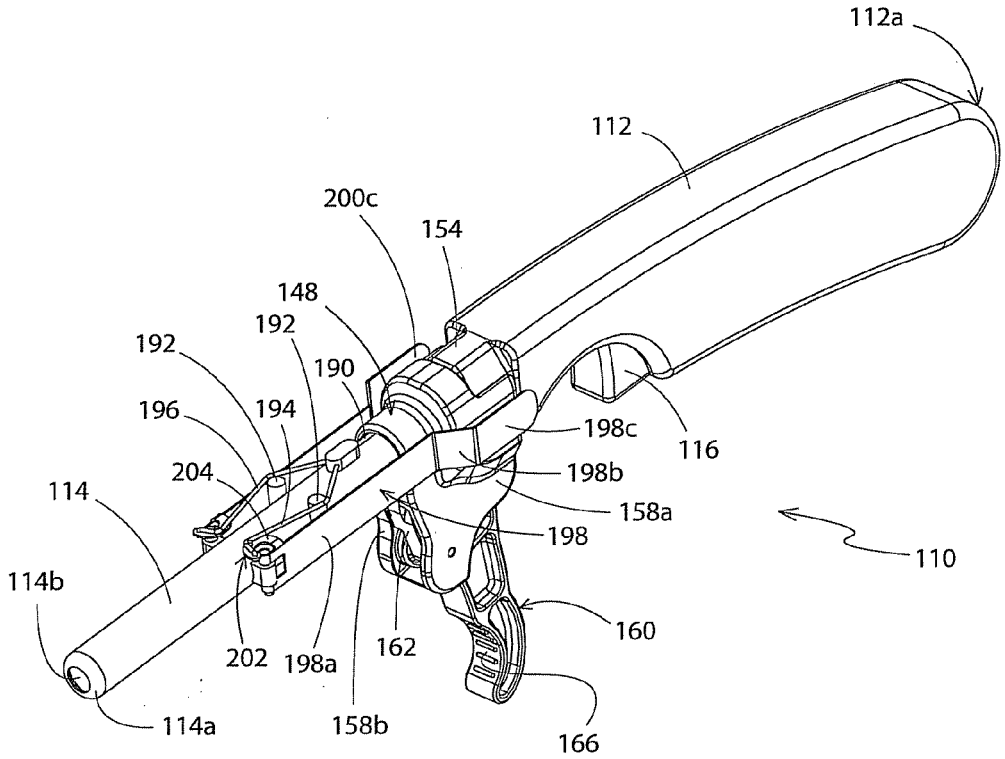
FIG. 13 is a front perspective view of a combined ignitor extinguisher device in accordance with the present invention showing a second embodiment of an extinguisher mechanism used thereon.

Device 10 includes a housing 12 that surrounds and defines an interior chamber (not shown) and which is designed to contain a quantity of fuel therein. A suitable fuel is compressed butane gas. Housing 12 is ergonomically configured to be easily gripped in a user's hand and preferably is manufactured from a plastic material. An elongate, cylindrical barrel 14 extends outwardly from housing 12 and terminates at a terminal end 14*a*. Barrel 14 preferably is metallic and flame proof and defines a bore 14*b* therethrough that is in fluid communication with the chamber inside of housing 12. Bore 14*b* terminates in an aperture at end 14*a* out of which an ignition flame extends when the lighter is activated. Housing 12 is provided with an ignitor mechanism to produce the ignition flame. The ignitor mechanism includes an igniter trigger 16 located in a recessed region 17. Igniter trigger 16 is an actuator for the ignition mechanism and is movable between an at rest position (FIG. 1) and an activated position (FIG. 11). This is accomplished by a user depressing the igniter trigger 16 with their index finger. This causes igniter trigger 16 to move rearwardly within recessed region 17 and toward the end 12*a* of housing 12, i.e., the trigger 16 moves in the direction of arrow "A" (FIG. 2). As required by law, igniter trigger 16 is provided with a safety lock (not shown) so that it cannot be accidentally depressed. As igniter trigger 16 is depressed, fuel is permitted to escape from the chamber within housing 12 and an ignitor (not shown) within one of barrel 14 and housing 12 ignites the fuel so that a flame 18 (FIG. 11) extends out of the end 14*a* of barrel 14. When igniter trigger 16 is released, a mechanism, such as a return spring, returns the igniter trigger 16 from the activated position to the at rest position. This both stops the flow of fuel from within the chamber and moves igniter trigger 16 forwardly within recessed region 17 and away from end 12*a* of housing 12 until it reaches the at rest position. Although not illustrated herein, housing 12 may also be provided with a flame adjustment mechanism for altering the size of the flame 18. All of the components 12-17 are found in the barbeque lighters that are currently known in the art. These components 12-17 function in a well-known fashion and therefore do not constitute the present invention in and of themselves. Components 12-17 constitute an ignitor mechanism in device 10 of the present invention.

In accordance with the present invention, device 10 is not only provided with components that constitute an ignitor mechanism that is used to ignite a flame, but the device also includes components that constitute an extinguisher mechanism that is used to extinguish a flame. Furthermore, the extinguisher mechanism in device 10 is activated separately from the ignitor mechanism therein. Still further, the activation of the extinguisher mechanism simultaneously prevents the activation of the ignitor mechanism. FIGS. 1-12 illustrate device 10 in accordance with the present invention and show a first embodiment of an extinguisher mechanism used thereon and generally indicated by the reference character 20. FIGS. 13-16 illustrate device 10 in accordance with the present invention and show a second embodiment of an extinguisher mechanism used thereon and generally indicated by the reference character 120.

Referring to FIGS. 1-12, extinguisher mechanism 20 is designed to extinguish a burning candle wick and comprises a snuffer apparatus 22 and an extinguisher trigger 24. Snuffer apparatus 22 is operationally engaged with extinguisher trigger 24 which is an actuator for snuffer apparatus. Extinguisher trigger 24 causes snuffer apparatus 22 to be moved between a first position (FIGS. 1-3) and a second position (FIGS. 5-8), as will be described hereafter. The movement of snuffer apparatus 22 is controlled by moving extinguisher trigger 24 between an at rest position and an activated position. When extinguisher trigger 24 is in the at rest position (FIGS. 1-3), then snuffer apparatus 22 is in the first position.

When extinguisher trigger 24 is in the activated position (FIGS. 5-8), then snuffer apparatus 22 is in the second position.

When snuffer apparatus 22 is in the first position, the extinguisher mechanism 20 is in a retracted condition and is not in a suitable position to be used to extinguish a flame, but the ignitor mechanism may be activated to ignite a flame. When snuffer apparatus 22 is in the second position, the extinguisher mechanism 20 is in an extended position and is actively used to extinguish a flame and, simultaneously, the ignitor mechanism cannot be activated to ignite a flame.

Snuffer apparatus 22 preferably is made from metal and comprises a sleeve 26, a slider 30, a first arm 34 and a second arm 36. Sleeve 26 is a tubular member having a first end 26*a* and a second end 26*b* and a longitudinal axis extending therebetween. Sleeve 26 defines a bore 28 therethrough that is complementary in size to the exterior diameter of barrel 14 and barrel 14 is received through bore 28. The longitudinal axis of sleeve 26 is parallel to the longitudinal axis of barrel 14 and both of these axes are identified by the letter "Y" in FIG. 3. Sleeve 26 is designed to slide back and forth along barrel 14 as extinguisher trigger 24 is moved between the at rest position and the activated position.

In accordance with a feature of the present invention, slider 30 preferably is fixedly connected to second end 26*b* of sleeve 26 and extends longitudinally outwardly therefrom in a first direction. Slider 30 preferably is a substantially planar component and a plurality of apertures 32 are defined in the slider 30 and are configured in a row that extends substantially parallel to the longitudinal axis "Y" of sleeve 26. Each aperture 32 extends between an upper and lower surface of slider 30 and the apertures 32 are spaced at intervals relative to each other along the length of slider 30. When sleeve 26 is engaged with barrel 14, slider 30 extends longitudinally along a portion of barrel 14 and is disposed adjacent an exterior surface thereof. In the preferred embodiment of the invention, slider 30 is disposed beneath a bottom surface 14*c* of barrel 14 (FIG. 5) and extends rearwardly toward igniter trigger 16.

Figure 4:
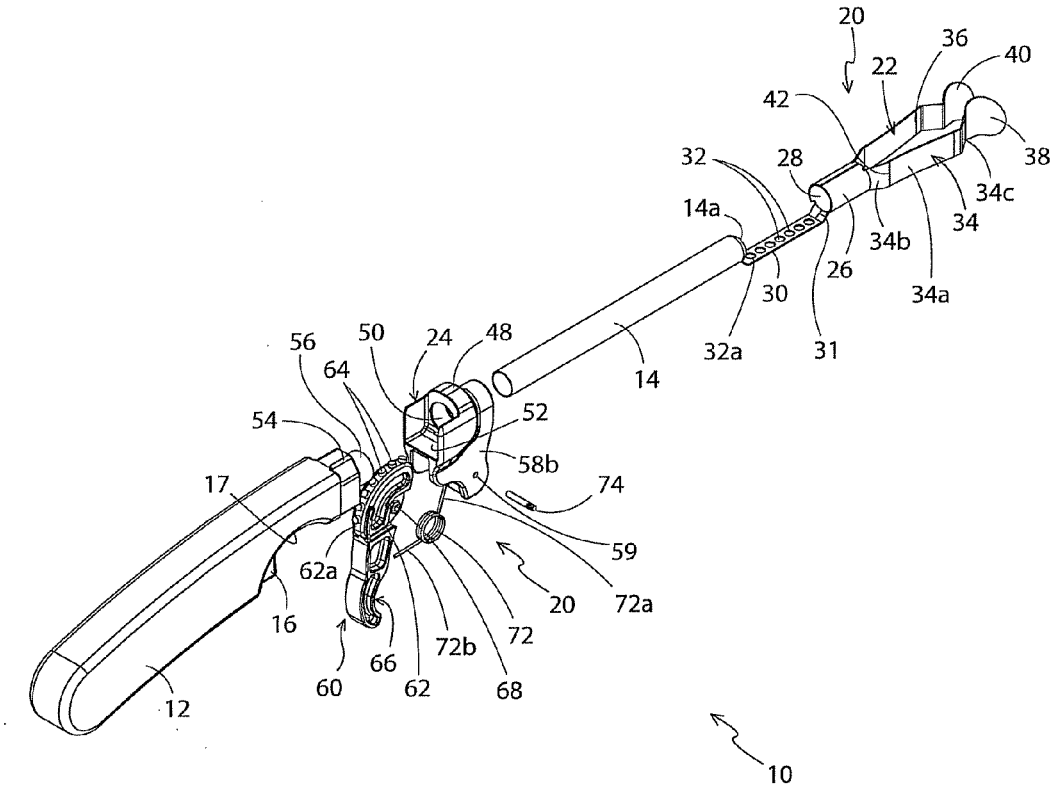
FIG. 4 is a partially exploded rear perspective view of the device of FIG. 1 showing the components of the extinguisher mechanism exploded away from the components of the ignitor mechanism.
Figure 5:
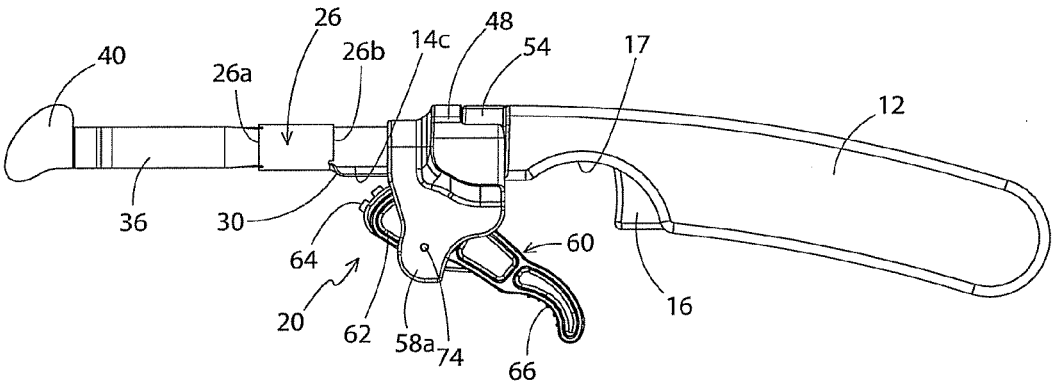
FIG. 5 is a left side view of the device showing the arms of the snuffer apparatus extended partially outwardly beyond the end of the barrel.
Figure 6:
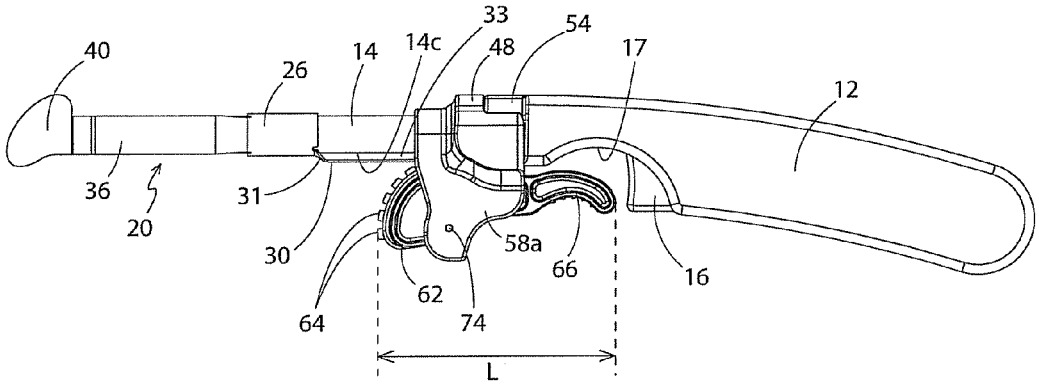
FIG. 6 is a left side view of the device showing the arms of the snuffer apparatus fully extended outwardly beyond the end of the barrel and in a position wherein the paddles would extinguish a burning candle wick, and showing the extinguisher trigger interfering with access to the igniter trigger.

As best seen in FIGS. 4 and 6, slider 30 is offset vertically relative to sleeve 26 and is connected to sleeve 30 by a downwardly sloping wall 31. Wall 31 aids in creating a gap 33 between slider 30 and bottom surface 14*c* of barrel 14. The purpose of gap 33 will be explained later herein.

First and second arms 34, 36 of snuffer apparatus 22 extend longitudinally forwardly from first end 26*a* of sleeve 26 and away from slider 30. First and second arms 34, 36 are stamped metal and are biased together during manufacture. First and second arms 34, 36 are substantially identical to each other and extend outwardly from sleeve 26 such that they are substantially at right angles to slider 30 and are opposed to each other. Consequently, when barrel 14 is received through bore 28 of sleeve 26 and slider 30 is disposed adjacent bottom surface 14*c* of barrel 14, first arm 34 is disposed adjacent side 14*c* of barrel 14, and second arm 36 is disposed adjacent side 14*d* thereof. For the sake of simplicity, first arm 34 will be described herein in detail but it will be understood that second arm 36 is a mirror image of the same.

Figure 8:
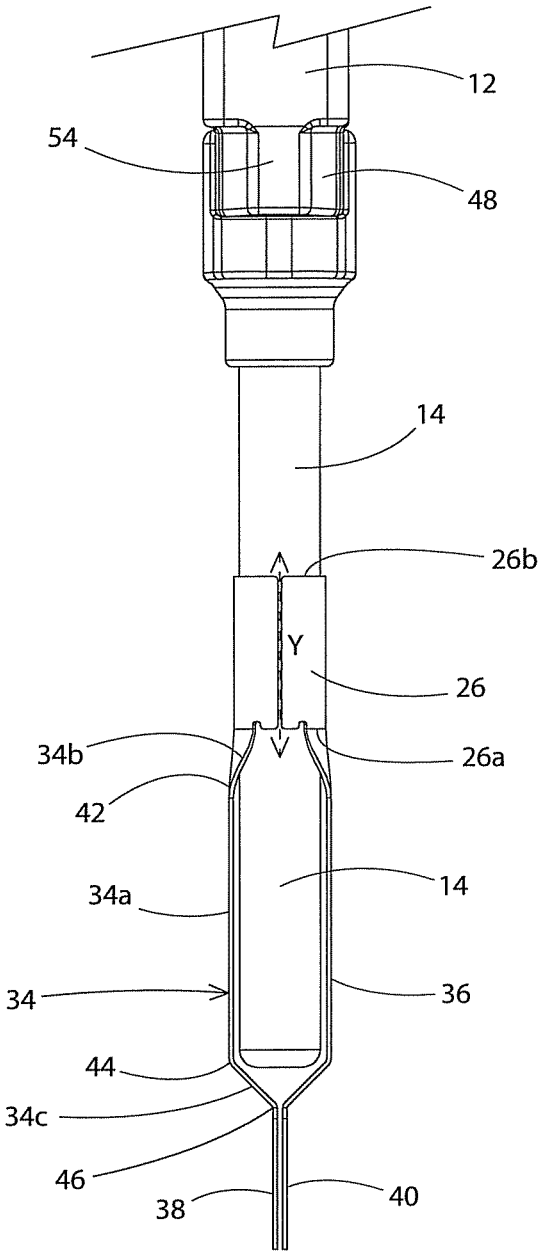
FIG. 8 is a top view of the device of FIG. 7.

First arm 34 includes a first face 34*a*, a second face 34*b* and a third face 34*c*. First face 34*a* has an interior surface that is substantially planar and is configured to be disposed adjacent side 14*c* of barrel 14. Second face 34*b* extends outwardly from a first end of first face 34*a* so that second face 34*b* is disposed at an acute angle relative to the interior surface of first face 34*a*. First and second faces 34*a*, 34*b* meet along a first transition region 42. Second face 34*b* is secured to sleeve 26 in such a manner that first face 34*a* is disposed substantially parallel to the longitudinal axis "Y" of sleeve 26 when sleeve 26 is not engaged with barrel 14 or when snuffer apparatus 22 is in the second position (FIG. 8). Third face 34*c* extends outwardly from a second end of first face 34*a* and at an acute angle to the interior surface thereof. First and third faces 34*a*, 34*c* meet along a second transition region 44. Second face 34*b* and third face 34*c* extend outwardly from the same side of first face 34*a* but flare outwardly in opposite directions relative to each other. When slider 26 is engaged with barrel 14, second and third faces 34*b*, 34*c* extend inwardly away from first face 34*a* and toward side 14*c* of barrel 14.

In accordance with another feature of the present invention, arm 34 has a paddle 38 extending forwardly from third face 34*c* and at an acute angle thereto. Paddle 38 meets third face 34*c* along a third transition region 46. Paddle 38 is an enlarged region having a planar inner surface that is positioned substantially parallel to the longitudinal axis "Y" of sleeve 26 when sleeve 26 is not engaged with barrel 14 or when snuffer apparatus 22 is in the second position. Additionally, when snuffer apparatus 22 is in the second position, paddle 38 is oriented parallel to first face 34*a* and is positioned a distance inwardly therefrom. Paddle 38 may be of any shape suitable for extinguishing a flame. Preferably, paddle 38 includes at least one lobe that extends one of vertically above and below barrel 14 when snuffer apparatus 22 is engaged therewith. In the preferred embodiment of the invention, paddle 38 includes two lobes 38*a*, 38*b* (FIG. 9) that are diametrically opposed to each other. Lobe 38*a* extends vertically above an upper surface 14*e* of barrel 14 and lobe 38*b* extends vertically below lower surface 14*b* of barrel 14.

Figure 7:
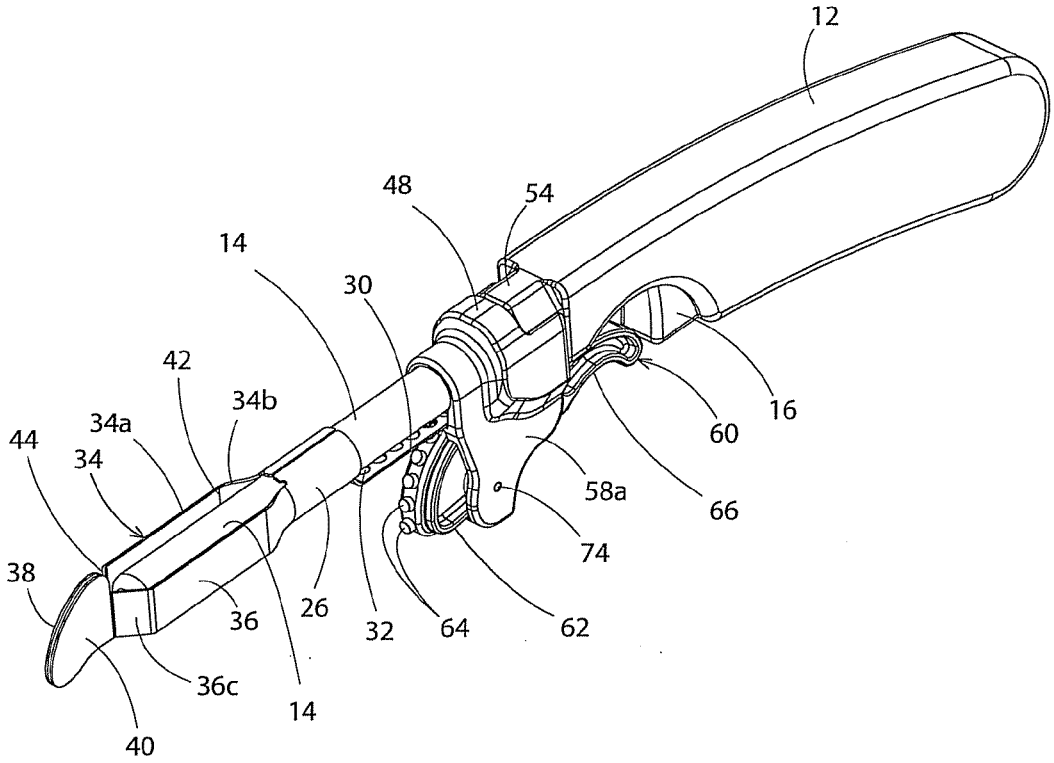
FIG. 7 is a front perspective view of the device of FIG. 6 showing the components of the extinguisher mechanism in the position where they would extinguish a burning candle wick.

Second arm 36 also includes a paddle 40 extending outwardly from the third face 36*c* thereof (FIG. 7). Paddle 40 preferably is substantially identical to paddle 38 and is positioned on snuffer apparatus 22 such that it comprises a mirror image of paddle 38. Second paddle 40 also includes two lobes 40*a*, 40*b* (FIG. 11) that are complementary in shape and position to lobes 38*a*, 38*b*. When snuffer apparatus 22 is moved into the second position, paddle 38 abuts paddle 40. When device 10 is angled upwardly or downwardly to extinguish a burning wick, lobes 38*a*, 38*b* and 40*a*, 40*b* will present an enlarged angled surface that is able to more fully capture the wick therein between. The shape of paddles 38, 40 provides good coverage of a wick 82 if it is approached from the side (if the candle is free standing) and also if it is approached from above such as in candle jar 80 where barrel 14 may have to be positioned at between 50 and 70 degrees from the horizontal. Paddles 38, 40 cannot be too large as they will then obstruct the user's vision and will cause access issues if device 10 is to be used to light and extinguish jar type candles. It will be noted that when paddles 38, 40 are brought into abutting contact with each other, paddles 38, 40 are substantially vertically oriented. This makes it easier to extinguish a burning wick 82 without damaging the same. Preferably, both of the paddles 38, 40 are manufactured from a material that is not combustible since they will be directly contacting a burning wick.

The spring steel arms 34, 36 and paddles 38, 40 are biased together at manufacture. When barrel 14 is received through bore 28 of sleeve 26 and extinguisher trigger 24 is in the at rest position (FIGS. 1-3), snuffer apparatus 22 is in the first position and arms 34, 36 are forced apart from each other by the barrel 14. Transition regions 46 engage sides 14*c*, 14*d* of barrel 14 and both of first and second arms 34, 36 are therefore under tension. Additionally, paddles 38, 40 flare outwardly from sides 14*c*, 14*d* of barrel 14 and at an angle thereto. Furthermore, as evident from FIGS. 2 & 3, sleeve 26 is disposed adjacent extinguisher trigger 24 and paddles 38, 40 are located rearwardly relative to end 14*a* of barrel 14. Snuffer apparatus 22 is therefore in a retracted position. This enables the user to easily see the end 14*a* of barrel 14 when they wish to position it correctly to light a candle wick or to extinguish a burning candle wick as will be hereinafter described.

Extinguisher trigger 24 is mounted on barrel 14 in front of housing 12. Extinguisher trigger 24 may be made from metal or plastic and includes a body 48 and a trigger member 60. Body 48 is secured to housing 12 and to barrel 14 while trigger member 60 is secured to body 48 and to slider 30 of snuffer apparatus 22. In the preferred embodiment of the invention, body 48 defines an aperture 50 therein sized to receive barrel 14 therethrough. Body 48 also includes a landing region 52 complementary shaped to interlockingly engage with a front end 54 of housing 12. A boss 56 extending forwardly from front end 54 of housing 12 is received through landing region 52 and into a rear portion of aperture 50. Barrel 14 extends rearwardly through a front portion of aperture 50 and interlockingly engages with boss 56 (FIG. 4). Body 48, barrel 14 and housing 12 may be secured together by friction, by adhesives, by fasteners, by welding or by any other suitable mechanism.

Body 48 also includes two spaced apart flanges 58*a*, 58*b* (FIG. 1) that extend downwardly for a distance below bottom surface 14*c* of barrel 14. Flanges 58*a*, 58*b* are disposed substantially at right angles to the longitudinal axis "Y" of barrel 14 and are horizontally separated from each other by a gap. A portion of trigger member 60 is received and retained within this gap. When snuffer apparatus 22 is mounted on barrel 14, sleeve 26 abuts a front edge 48*a* of body 48 and slider 30 extends through the gap between flanges 58*a*, 58*b*. Each flange 58*a*, 58*b* defines a hole 59 therein and these holes 59 are oriented at right angles to longitudinal axis "Y" of sleeve 26 and are horizontally aligned with each other.

Trigger member 60 is pivotally secured to body 48 in an upside-down orientation by way of a pin 74 that extends through a hole 68 (FIG. 4) in trigger member 60. Trigger member 60 preferably is molded from a plastic material and includes an arcuate cog wheel 462 having an upper surface 62*a* with a plurality of spaced apart teeth 64 radiating outwardly therefrom. The spacing between adjacent teeth is complementary to the spacing between apertures 32 on slider 30. When slider 30 is extended into the gap between flanges 58*a*, 58*b*, at least one tooth 64 on cog wheel 62 is received through at least one aperture 32 on slider 30. Cog wheel 62 therefore acts as a gear and slider 30 acts as a rack that engages teeth 64 on cog wheel 62. The teeth 64 project upwardly from cog wheel 62 and into gap 33 (FIG. 6) between slider 30 and bottom surface 14*b* of barrel 14. Gap 33 provides a space for teeth 64 to extend into as cog wheel 62 is rotated about pivot pin 74.

Trigger member 60 further includes a finger rest 66 for a user to position their index finger so that they may easily activate extinguisher trigger 24. Finger rest 66 preferably is a concave recession on trigger member 60 and is provided with some sort of knurling. In the preferred embodiment, finger rest 66 includes a plurality of raised ridges that act as a gripping surface. Preferably trigger member 60 is molded from a suitable plastic and may also include one or more cut out regions 70 to reduce the weight of the component.

In accordance with yet another feature of the present invention, extinguisher trigger 24 also includes a return spring 72 seated into a recessed region surrounding aperture 68 on trigger member 60. The arms 72*a*, 72*b* of return spring 72 are positioned so that a first one 72*a* thereof engages one of housing 24 and flanges 58*a*, 58*b* and a second one 72*b* thereof engages trigger member 60. Return spring 72 is biased so as to maintain extinguisher trigger 24 in its at rest position so that paddles 38, 40 of snuffer apparatus 22 are positioned rearwardly of end 14*a* of barrel 14.

In accordance with another specific feature of the present invention, trigger member 60 is located in an easily accessed location and yet is positioned sufficiently far enough in front of igniter trigger 16 that the user will not tend to confuse the first and second triggers 16, 24. In this way, the user will be less inclined to accidentally engage the extinguisher trigger 24 if they intended to engage the igniter trigger 16, and vice versa.

In accordance with yet another specific feature of the present invention, trigger member 60 is of a sufficient length "L" (FIG. 6) that, when it is moved into the activated position, trigger member 60 extends into and across a substantial portion of the recessed region 17. In this way, trigger member 60 physically blocks access to igniter trigger 16 so that the user cannot insert their index finger into the recessed region 17 and depress igniter trigger 16. This safety feature prevents the user from accidentally depressing igniter trigger 16 when they actuate extinguisher trigger 24. This arrangement therefore causes the ignitor mechanism on device 10 to be simultaneously deactivated when the extinguisher mechanism is activated.

Figure 3:
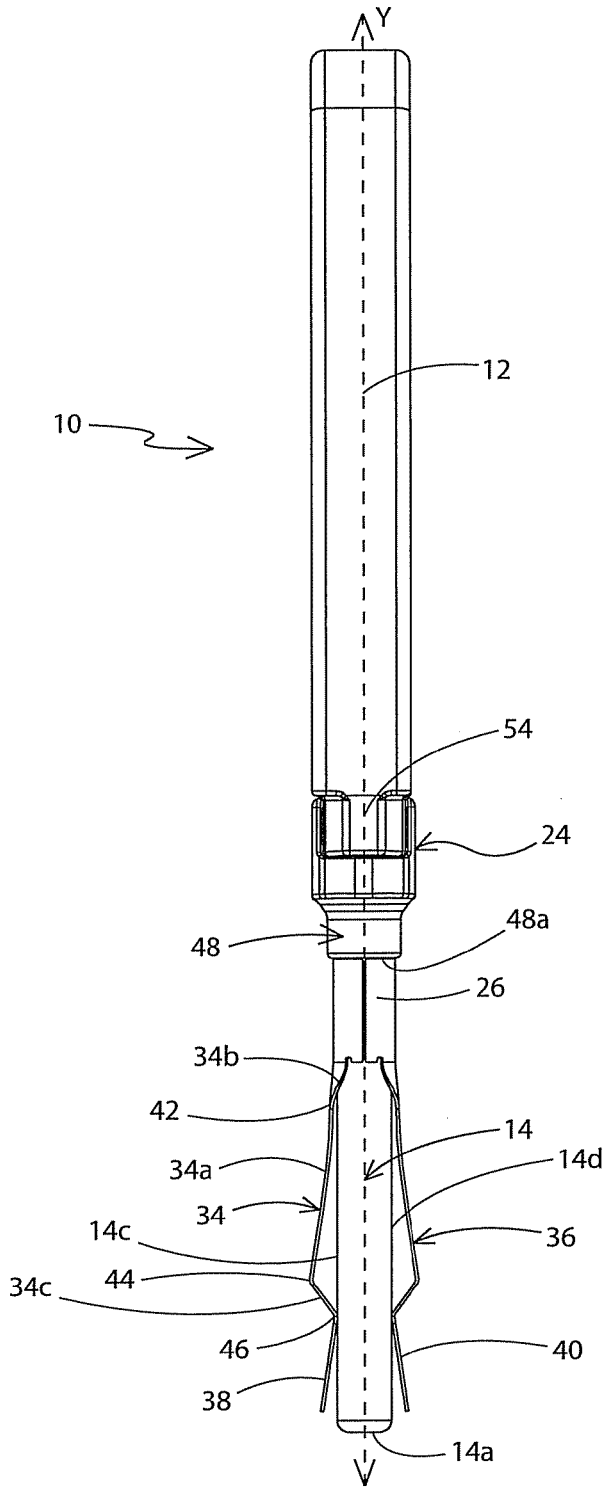
FIG. 3 is a top view of the device of FIG. 1 showing the position of the arms of the snuffer apparatus relative to the flame-emitting end of the barrel.

Device 10 is used in the following manner. When the user wishes to light a candle 84, such as the one retained in a candle jar 80 shown in FIGS. 11 & 12, they hold device 10 and insert barrel 14 of device 10 into the opening 80*a* of jar 80. (The user's hand has not been shown in the figures to simply the drawings.) Barrel 14 is positioned so that end 14*a* thereof is located adjacent wick 82. Initially igniter trigger 16 is in the at rest position and extinguisher trigger 24 is in the first position, i.e., the device 10 is as shown in FIG. 2. Thus, initially, no fuel is being released from the chamber in housing 12 by igniter trigger 16. Additionally, trigger member 60 of extinguisher trigger 24 extends outwardly from housing 12 and generally at right angles to the longitudinal axis "Y" thereof. Furthermore, trigger member 60 does not extend across or into recessed region 17. Still further, because extinguisher trigger 24 is in the first position, sleeve 26 is positioned adjacent end 48*a* of body 48 and paddles 38, 40 are retracted inwardly from end 14*a* of barrel 14 and are under spring tension (FIG. 3). The positioning of snuffer apparatus 22 is such that the user can easily see the front end 14*a* of barrel 14 as the paddles 38, 40 are not obstructing the same.

The user then depresses igniter trigger 16 by pulling their index finger toward the end 12*a* (FIG. 1) of housing 12. This moves igniter trigger 16 within the recessed region 17 in the direction of arrow "A" (FIG. 2) to the position shown in FIG. 11, thereby permitting release of a quantity of fuel from within the chamber of housing 12. The ignitor (not shown) within one of barrel 14 and housing 12 ignites the fuel and a flame 86 extends outwardly from front end 14*a* and lights wick 82 so that it burns with a flame 88. When the user removes their finger from igniter trigger 16, the igniter trigger 16 moves from the activated position (FIG. 11) back to the at rest position (FIG. 2) and the flow of fuel stops.

Figure 9:
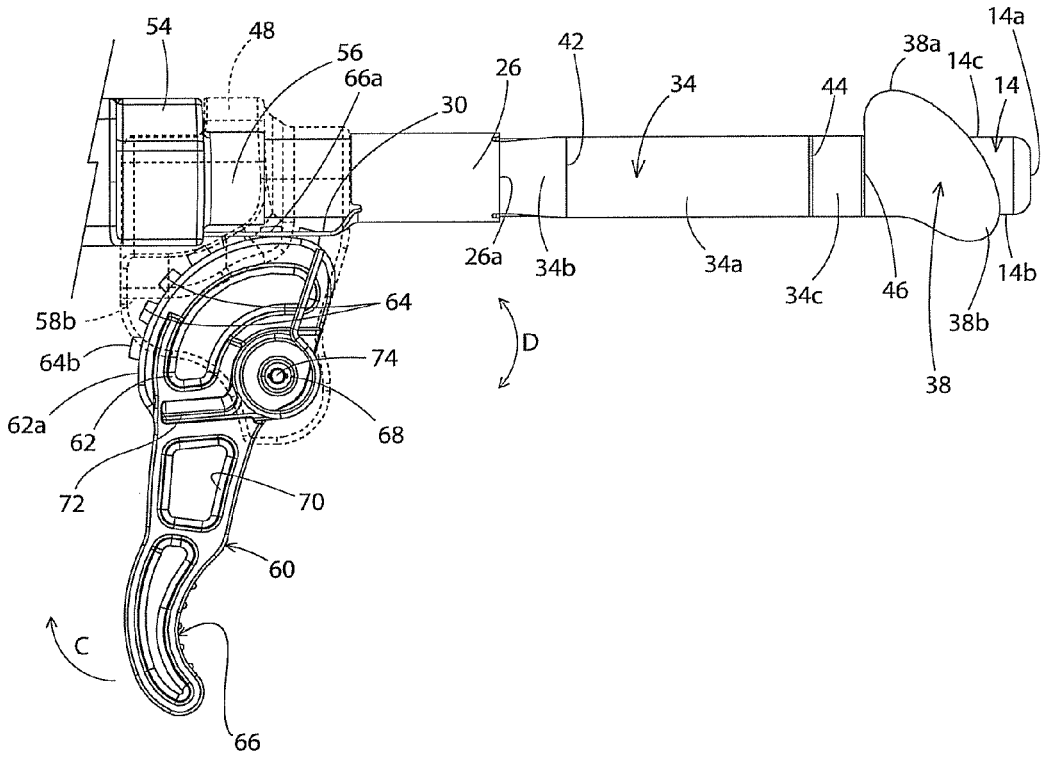
FIG. 9 is a partial right side view of the device showing the position of the extinguisher trigger teeth relative to the slider when the extinguisher trigger is in the at rest position.
Figure 10:
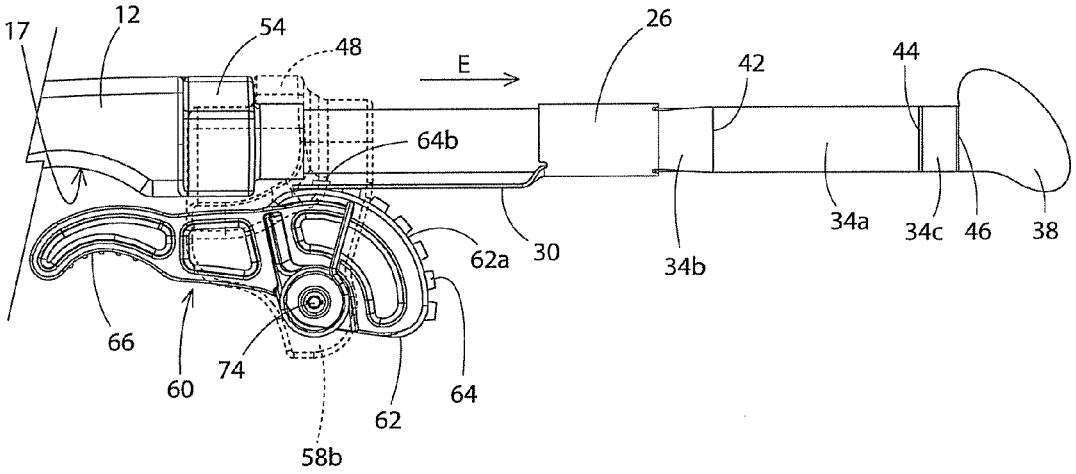
FIG. 10 is a partial right side view of the device showing the position of the extinguisher trigger teeth relative to the slider when the extinguisher trigger is in the activated position.

When the user wishes to extinguish the flame 88, they position device 10 in much the same location and manner as they would to light the wick 82. Consequently, the user holds housing 12 in such a position that front end 14*a* of barrel 14 is positioned adjacent wick 82. Initially, once again, the igniter trigger 16 is in the at rest position and the extinguisher trigger 24 is in the first position (as in FIG. 2). The user moves extinguisher trigger 24 into the activated position by placing an index finger on finger rest 66 of trigger member 60 and squeezing extinguisher trigger 24 by pulling their finger toward end 12*a* of housing 12. This movement causes trigger member 60 to rotate about pivot pin 74 in the direction of arrow "C" (FIGS. 9-11). As trigger member 60 pivots, cog wheel 62 moves in the direction of arrow "D". Since at least one of the teeth, such as tooth 64*a* (FIG. 9) extends through at least one of the apertures 32 in slider 30 and into gap 30, the pivoting motion of trigger member 60 causes slider 30 to be moved forwardly by cog wheel 62 in the direction of arrow "E" toward end 14*a* of barrel 14 by progressively moving teeth 64 into the complementary positioned apertures 32 on slider 30. When tooth 64*b* is engaged in the rearmost aperture 32*a* (FIG. 4) of slider 30, the forward motion of slider 30 is stopped. Since sleeve 26 is connected to slider 30, when slider 30 moves forwardly toward end 14*a*, sleeve 26 and the arms 34, 36 extending outwardly therefrom moves toward end 14*a* of barrel 14 in the direction of arrow "E". As soon as transition regions 44 on first and second arms 34, 36 slide past end 14*a*, the spring tension in first and second arms 34, 36 is released and the arms move inwardly toward each other into the position shown in FIG. 8. The inward motion results in the interior surface of paddle 38 abutting the interior surface of paddle 40, capturing burning wick 82 between them. Since the interior surfaces of paddles 38 and 40 are planar, the wick 82 is tightly clamped between paddles 38, 40 and the supply of oxygen to wick 82 from the surrounding air is cut off. The flame 88 is therefore snuffed out.

As discussed previously and as evident from FIG. 12, when extinguisher trigger 24 is moved into the activated position, trigger member 60 obstructs recessed region 17 and prevents igniter trigger 16 from being depressed. Thus, the ignitor mechanism is rendered inoperable by extinguisher trigger 24.

Once the flame 88 is extinguished by paddles 38, 40, the user releases trigger member 60. Return spring 72 returns to its original position thereby causing cog wheel 62 to rotate in the opposite direction to arrow "D". This, in turn, causes slider 30 to be moved rearwardly in the opposite direction to arrow "E". As transition regions 44 on first and second arms 34, 36 encounter end 14*a* of barrel 14, they are forced to move outwardly away from each other, thereby creating spring tension once again in first and second arms 34, 36. When return spring 72 is fully returned to its original condition, second end 26*b* of slider 26 is in abutting contact with end 48*a* of body 48 and paddles 38, 40 are disposed rearwardly of end 14*a* once again (FIG. 2). First and second arms 34, 36 and paddles 38, 40 are biased together at manufacture and squeeze together along barrel 14 until the transition regions 46 pass end 14*a*. Arms 34, 36 and paddles 38, 40 then come together with a gentle controlled force resulting from the release of the spring tension in arms 34, 36. This movement is sufficiently gentle enough to extinguish the flame without breaking or tearing the fragile burnt wick 82. Extinguishing mechanism is a fairly simple system that keeps all components close to barrel 14 so the barrel 14 fits well in the mouth of a long narrow candle jar 80 (FIG. 11).

FIGS. 13-16 show a second embodiment of extinguishing mechanism 120 that may be incorporated into a device 110 in accordance with the present invention. Once again, device 110 includes the components that provide the ignition function in presently known barbeque lighters. These known components are numbered in FIGS. 13-16 as components 112-117 and are substantially identical to components 12-17.

In device 110, the extinguishing mechanism 120 comprises a snuffer apparatus 122 and an extinguisher trigger 124. Extinguisher trigger 124 is substantially identical in structure and function to extinguisher trigger 24 and will not be described in further detail herein.

Snuffer apparatus 122 includes a body 148 that is substantially identical in structure and function to body 48. In accordance with a specific feature of the present invention, a substantially Y-shaped spring member 190 that extends forwardly from end 148*a* of body 148. Leg 190 preferably is positioned adjacent the upper surface 114*e* of barrel 114 and is disposed substantially parallel to the longitudinal axis "Y" (FIG. 14) of barrel 114. It will be understood, however, that spring member 190 may be mounted adjacent one of sides 114*c*, 114*d* or adjacent bottom surface 114*b* of barrel 114 without departing from the spirit of the present invention.

Figure 14:
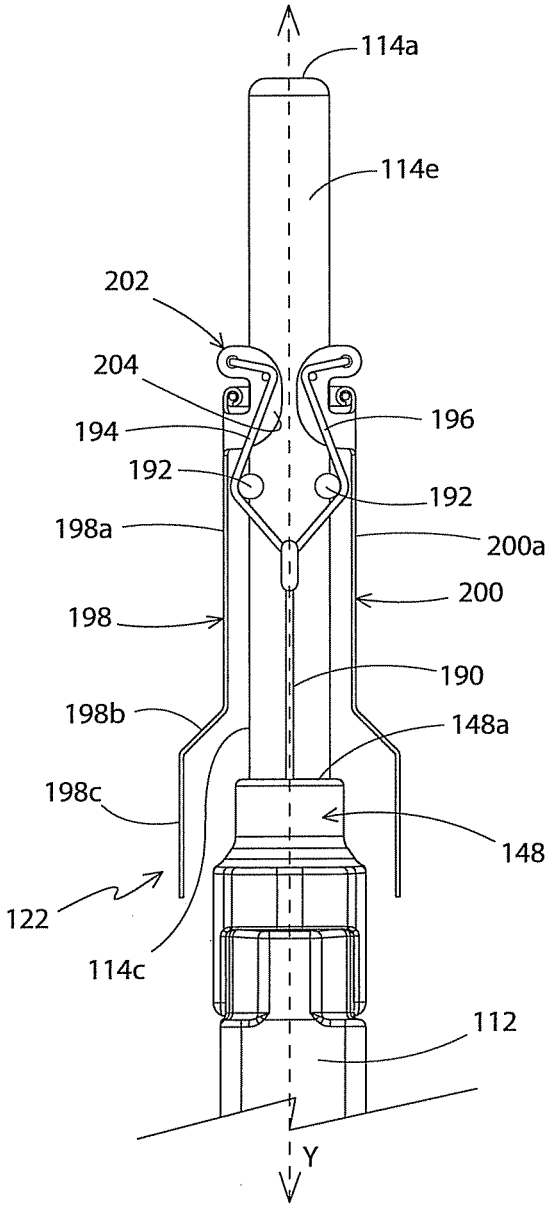
FIG. 14 is a partial top view of the device of FIG. 13 showing the snuffer apparatus mounted on the barrel of the device and showing the snuffer arms in a first position where they extend rearwardly toward the body of the device.

Spring member 190 includes a first leg 194 and a second leg 196 that extend outwardly away from each other. A pair of spaced apart pins 192 extend upwardly from upper surface 114*e* of barrel 114 and engage first and second legs 194, 196. First and second legs 194, 196 are positioned so that both pins 192 are located between them. Furthermore, first leg 194 abuts an outer surface of one of the pins 192 and second leg 196 abuts an outer surface of the other of the pins 192. First and second legs 194, 196 are generally "Z" shaped when snuffer apparatus 122 is in the first position (FIG. 14). A first arm 198 is pivotally connected to the forwardmost end of first leg 194 and a second arm 200 is pivotally connected to the forwardmost end of second leg 196. First arm 198 and second arm 200 are substantially identical in structure and function. For the sake of simplicity, only first arm 198 will be described herein. First arm 198 includes a first section 198*a*, a second section 198*b*, and a paddle 198*c*. When snuffer apparatus 122 is in the first position, first section 198*a* is disposed substantially parallel to the longitudinal axis "Y" of spring member 190 and barrel 114. Paddle 198*c* is similarly disposed substantially parallel to the longitudinal axis "Y" but is spaced further away from side 114*c* of barrel 114 than is first section 198*a*. Second section 198*b* is angled between first leg and paddle 198*a*, 198*c*.

In accordance with a specific feature of the present invention, a hinge member 202 is provided at the end of each of first and second legs 194, 196. Thus, first leg 194 is secured by a first hinge member 202 to first arm 198 and second leg 196 is secured by a second hinge member 202 to second arm 200. Each hinge member 202 includes a generally C-shaped plate 204 that is fixedly secured to the forwardmost end of the associated first and second leg 194, 196. Hinge member 202 is attached to first section 198*a*, 200*a* of first and second arms 198, 200 by a hinge spring 206. First and second arms 198, 200 are held in the first position (FIG. 14) by the much stronger spring-biased extinguisher trigger 124. In this first position, the first and second arms 198, 200 are retracted away from end 114*a* of barrel 114 and first sections 198*a*, 200*a* of arms 198, 200 extend rearwardly away from end 114*a* and are adjacent sides 114*c*, 114*d* of barrel 114. When extinguisher trigger 114 is activated, the spring action of the trigger is overcome and hinge springs 206 bias arms 198, 200 into the second position or the closed position (FIG. 16) where paddles 198*c*, 200*c* abut each other.

The device 110, which includes the second embodiment of the extinguisher mechanism 120, is used in the following manner. Device 110 is used to light a candle wick in the same manner as device 10. When the user wishes to extinguish the burning candle wick, they depress extinguisher trigger 124. As with extinguisher trigger 24, this activation motion pivots the extinguisher trigger 124 into a substantially identical position as that shown in FIG. 12. In this position, the extinguisher trigger 124 physically obstructs access to the igniter trigger 116 and therefore prevents the ignitor mechanism of device 110 from being operated.

Figure 15:
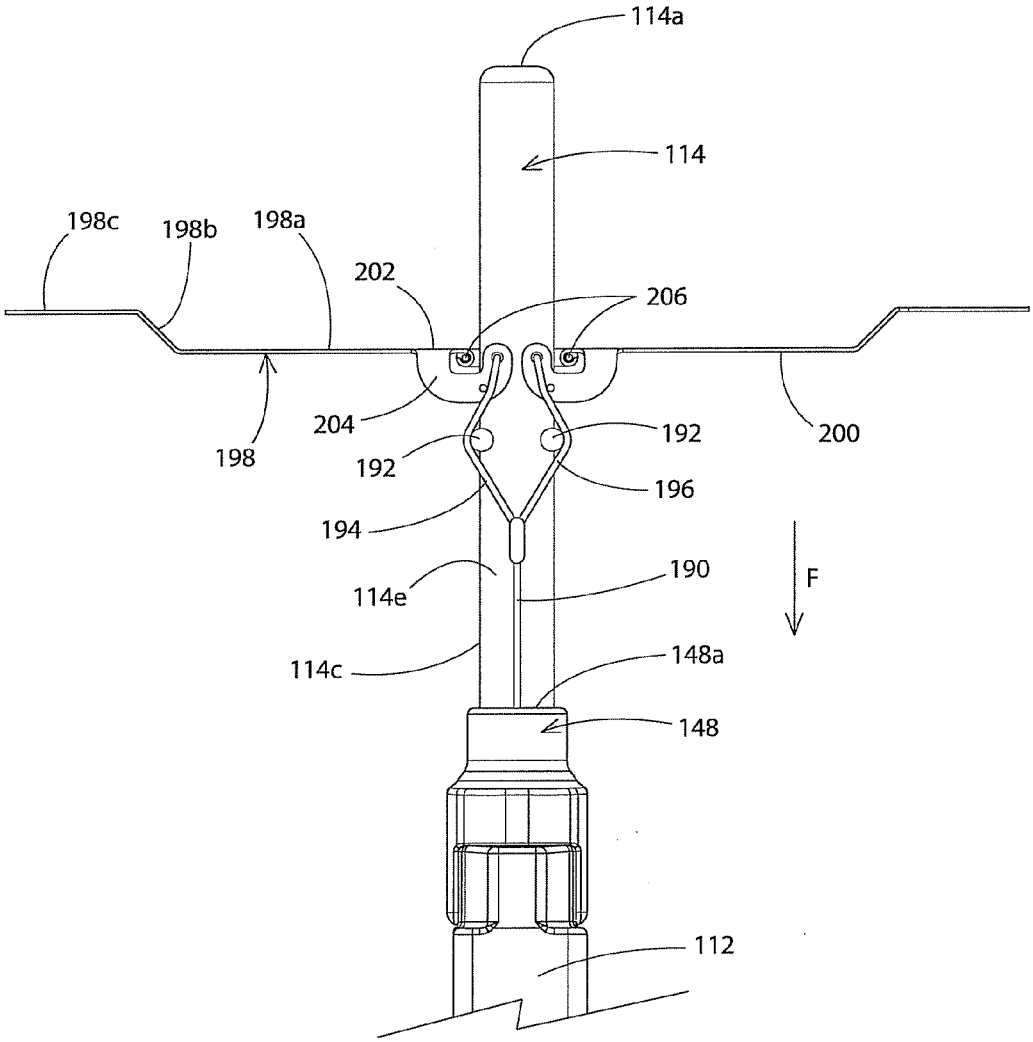
FIG. 15 is a partial top view of the device of FIG. 13 showing the snuffer arms rotated partially forwardly to an intermediate position.
Figure 16:
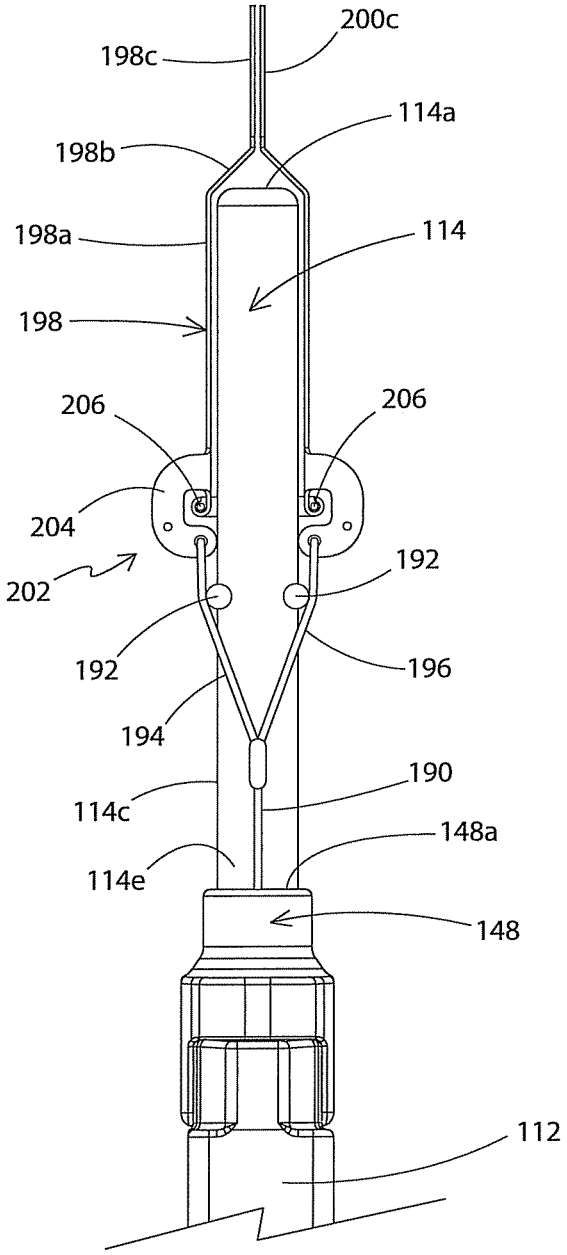
FIG. 16 is a partial top view of the device of FIG. 13 with the snuffer arms pivoted into a second position where they are able to clamping engage a candle wick between them.
Figure 17:
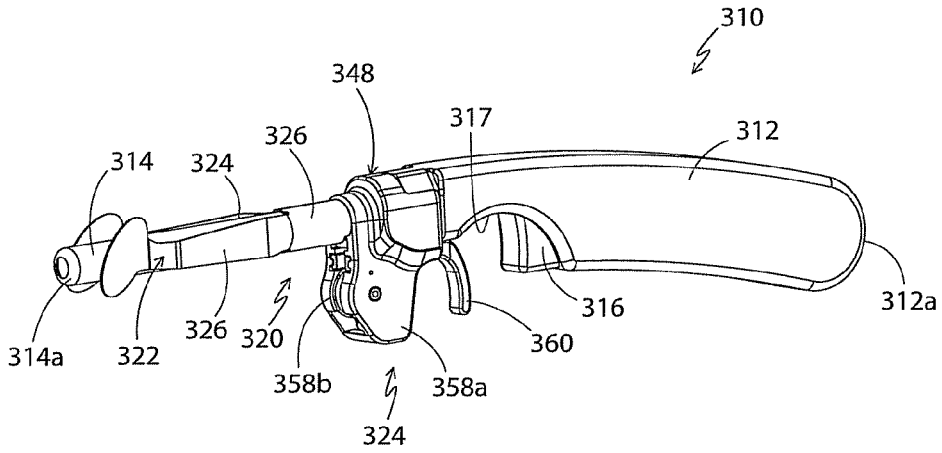
FIG. 17 is a front perspective view of a combined ignitor extinguisher device in accordance with the present invention showing a third embodiment of an extinguisher mechanism used thereon.
Figure 18:
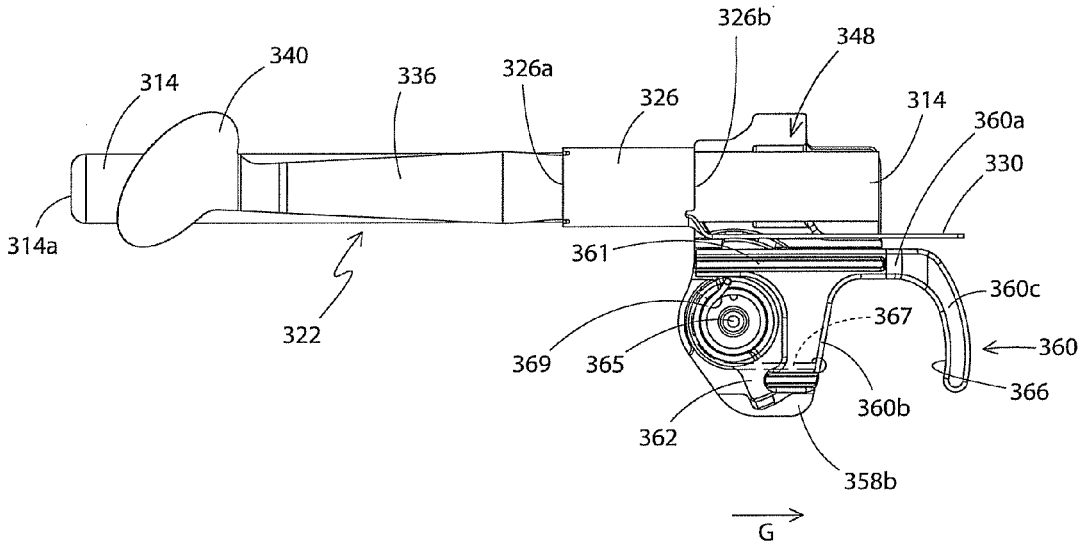
FIG. 18 is a partial left side view of the device of FIG. 17 with the extinguisher mechanism cover removed to reveal the cable operated extinguisher mechanism in the at rest position.

The user positions end 114*a* of barrel 114 adjacent a burning candle wick. They then activate extinguisher trigger 124. When extinguisher trigger 124 is activated, the spring force of the spring therein (the equivalent of spring 72) is overcome and spring member 190 is pulled rearwardly in the direction of arrow "F" (FIG. 15). This motion causes first and second legs 194, 196 to be straightened from the substantially Z-shaped configuration (FIG. 14) to a more linear shape (FIG. 16). The motion also causes plates 204 to pivot through 180 degrees drawing first and second arms 198, 200 through an arc of 180 degrees. So, in the first position (before extinguisher trigger 124 is activated), first sections 198*a*, 200*a* extend rearwardly along barrel 114. In an intermediate position after actuation of extinguisher trigger 124, first sections 198*a*, 200*a* are disposed substantially at right angles to sides 114*c*, 114*d* of barrel. In a final position, first sections 198*a*, 200*a* extend forwardly toward end 114*a* of barrel 114 and paddles 189*c*, 200*c* are brought into abutting contact with each other and the burning candle wick is captured between them. This action snuffs out the flame. As with the previous embodiment, snuffer apparatus 122 provides a gentle and controlled wick clamping action controlled by the small paddle hinge springs 206 that substantially prevents the snuffed wick, from being broken off or otherwise damaged.

When the user releases extinguisher trigger 124, the spring therein (similar to spring 72) causes extinguisher trigger 124 to move from the activated position back to the at rest position. Spring member 190 is moved forwardly once again, thereby permitting first and second legs 194, 196 to return to their Z-shape and causing plates 204 to rotate back through 180 degrees. As this occurs, first and second arms 198, 200 rotate through 180 degrees moving first and second arms 198, 200 through the reverse motion (FIGS. 16 to 15 to 14) until the components are back in the position shown in FIG. 14.

Referring to FIGS. 17-21 there is shown an ignitor extinguisher device 310 that includes a third embodiment of an extinguisher mechanism in accordance with the present invention and generally indicated at 320. Once again, device 310 includes the components that constitute an ignitor mechanism that is utilized in presently known barbeque lighters. These known components are numbered in FIGS. 17-21 as components 312-317 and are substantially identical in structure and function to components 12-17.

As with the previous embodiments, extinguisher mechanism 320 provided in device 310 is activated separately from the ignitor mechanism therein. Still further, the activation of extinguisher mechanism 320 simultaneously prevents the activation of the ignitor mechanism. Extinguisher mechanism 320 is designed to extinguish a burning candle wick and comprises a snuffer apparatus 322 and an extinguisher trigger 324. Snuffer apparatus 322 is operationally engaged with extinguisher trigger 324 and is activated by thereby. Extinguisher trigger 324 causes snuffer apparatus 322 to be moved between a first position (FIG. 18) and a second position (FIGS. 19-21), as will be described hereafter. The movement of snuffer apparatus 322 is controlled by moving extinguisher trigger 324 between an at rest position and an activated position. When extinguisher trigger 324 is in the at rest position (FIG. 18) then snuffer apparatus 322 is in the first position and is retracted relative to the front end 314*aa* of barrel 314. When extinguisher trigger 324 is in the activated position (FIGS. 19-21) then snuffer apparatus 322 is in the second position and at least a portion thereof extends outwardly beyond front end 314*a* of barrel 314.

Snuffer apparatus 322 is substantially identical to snuffer apparatus 22 and includes a sleeve 326, a slider 330, a first arm 334 and a second arm 336. First arm 334 includes a first paddle 338 thereon and second arm 336 includes a second paddle 340 thereon. As with sleeve 26, sleeve 326 is designed to slide back and forth along barrel 314 as extinguisher trigger 324 is moved between the at rest position and the activated position. First and second arms 234, 336 of snuffer apparatus 322 extend longitudinally forwardly from first end 326 a of sleeve 326 and toward front end 314*a* of barrel 314. First and second arms 334, 336 are substantially identical in structure and function to first and second arms 34, 36 and includes first and second paddles 338, 340, respectively. Slider 330 preferably is fixedly connected to a second end 326*b* (FIG. 18) of sleeve 326 and extends longitudinally outwardly therefrom along a portion of barrel 314 and toward end 314*a* of housing 312. Slider 330 includes a plurality of apertures 332 therein. As in device 10, a gap 333 is defined between slider 330 and bottom surface 314*c* of barrel 314.

In accordance with a specific feature of the present invention, extinguisher trigger 324 differs in several aspects from extinguisher trigger 24. Extinguisher trigger 324 includes a body 348 and a trigger member 360. Body 348 is substantially identical in structure and function to body 48 and is secured to housing 312 and barrel 314 in substantially the same manner that body 48 is secured to housing 12 and barrel 14. As with body 48, body 348 includes two spaced apart flanges 358*a*, 358*b* (FIG. 21) that extend downwardly for a distance below bottom surface 314*c* of barrel 314. The flanges 358*a*, 358*b* are substantially identical to flanges 58*a*, 58*b* and are horizontally separated from each other by a gap (unnumbered). However, unlike flanges 58*a*, 58*b*, flanges 358*a*, 358*b* are each provided with a track 363 (FIG. 19) that is oriented substantially parallel to the longitudinal axis of barrel 314. The tracks 363 on the two flanges 358*a*, 358*b* are horizontally aligned with each other. Additionally, a pivot pin 365 extends between flanges 358*a* and 358*b* a distance away from tracks 363 and further away from barrel 314 than tracks 363. Pivot pin 365 is disposed substantially at right angles to the longitudinal axis of barrel 314.

In accordance with yet another feature of the invention, a cog wheel 362 is mounted on pivot pin 365 and is designed to rotate about pivot pin 365. Wheel 362 has an arcuate outer surface 362*a* that includes a plurality of spaced apart teeth 364 which are extend radially outwardly from surface 362*a*. The spacing between adjacent teeth 364 is complementary to the spacing between apertures 332 on slider 330. When slider 330 is extended into the gap between flanges 358*a*, 358*b* at least one tooth 364 on cog wheel 362 is received in at least one aperture 332 on slider 330.

In accordance with yet another feature of the present invention, a first end of a cable 367 is connected to a pulley 391. Pulley 391 may be integrally formed with cog wheel 362 or may be a separate component that is coaxially mounted with cog wheel 362 on pivot pin 365 and is operationally connected to cog wheel 362. Pulley 391 is designed to rotate around the axis extending through pivot pin 365 and at right angles to the longitudinal axis "Y" of barrel 314. A second end of cable 367 is secured to trigger member 360. Cable 367 is preferably a thin steel or nylon cable.

A first end of a return spring 369 is secured to one of flanges 358*a*, 358*b* and a second end of the return spring 369 is secured to one of cog wheel 362 and pulley 391. Return spring 369 biases trigger member 360 into the at rest position.

Figure 19:
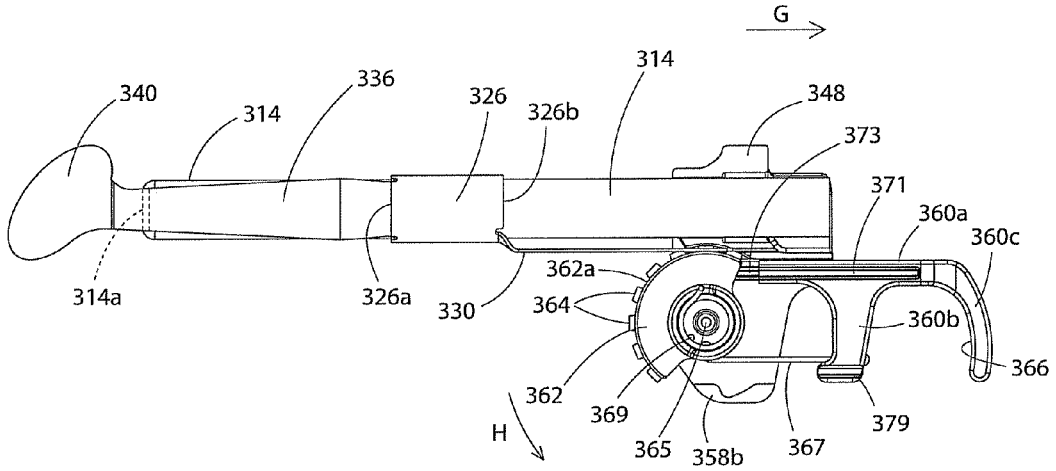
FIG. 19 is a partial left side view of the device of FIG. 17 with the extinguisher mechanism cover removed and showing the cable operated extinguisher mechanism in the activated position.
Figure 20:
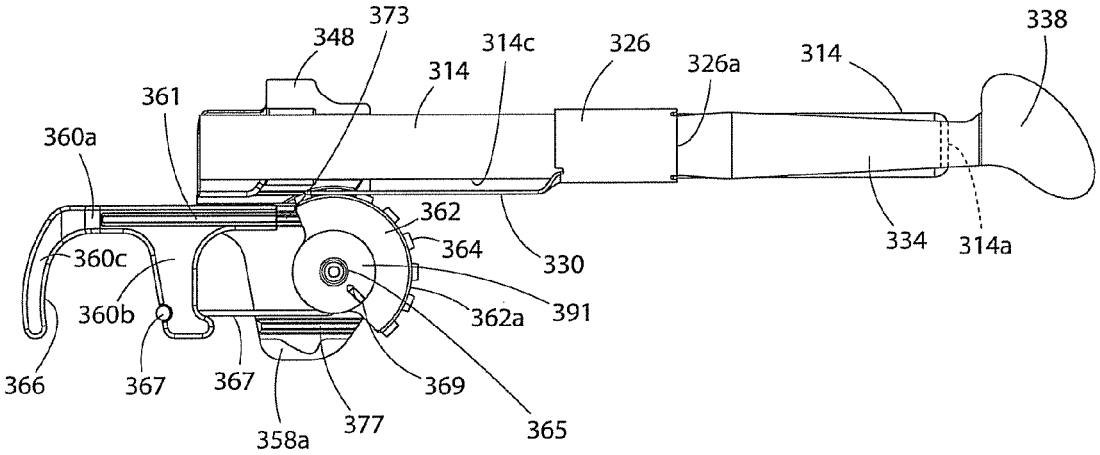
FIG. 20 is a partial right side view of the device of FIG. 19.
Figure 21:
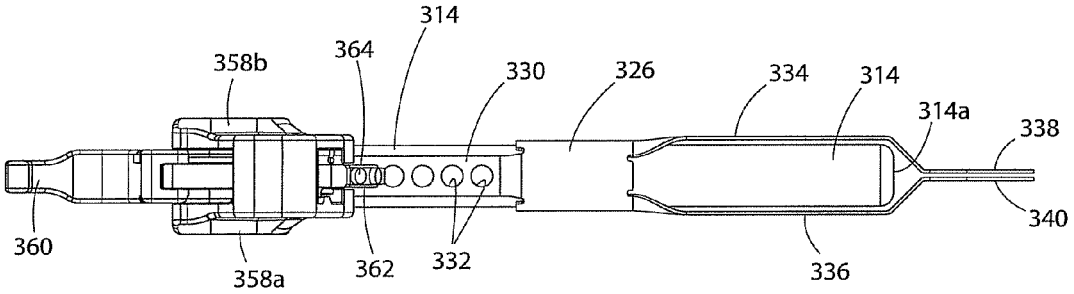
FIG. 21 is a partial bottom view of the device of FIG. 19.
Figure 22:
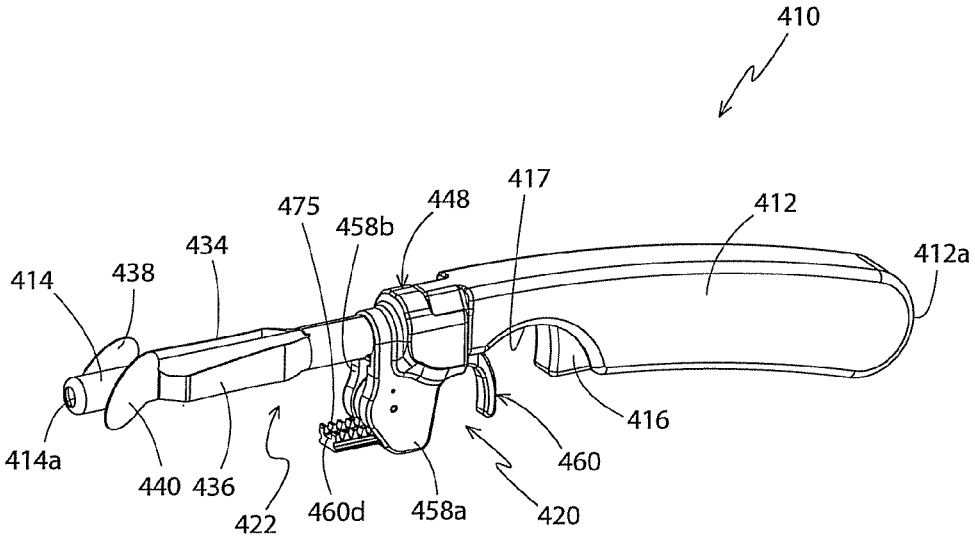
FIG. 22 is a front perspective view of a combined ignitor extinguisher device in accordance with the present invention showing a fourth embodiment of an extinguisher mechanism used thereon.

Trigger member 360 differs structurally from trigger member 60. Trigger member 360 is a substantially "F" shaped member that includes a horizontal region 360*a* with two legs 360*b* and 360*c* extending generally outwardly away from region 360*a* in the same direction and longitudinally spaced apart from each other. The second end of cable 367 is secured to first leg 360*b*. Horizontal region 360*a* is provided with one of a track and slot 361 that is designed to interlockingly engage with tracks 363 on body 348. The track or slot 361 is oriented substantially parallel to the longitudinal axis of barrel 314 when trigger member 360 is engaged with tracks 363. Trigger member 360 is able to move back and forth along tracks 363 between an at rest position (FIG. 18) and an activated position (FIG. 19). Although not illustrated herein, one of trigger member 360 and body 348 preferably is provided with a stop to prevent trigger member 360 from completely disengaging from body 348 when trigger member 360 is moved into an activated position. It will be understood that, instead of interlocking tracks 363 and slot or track 361, body 348 and trigger member 360 may be provided with any other type of cooperative mechanism that will allow the trigger member 348 to move longitudinally back and forth on device 320.

Device 320 is used in the following manner. Front end 314*a* of barrel 314 is positioned adjacent a burning wick of a candle (such as is shown in FIG. 11). The user positions their trigger finger on the finger rest 366 of trigger member 360 when it is in the at rest position (FIG. 18) and depresses the same. This causes trigger member 360 to move along the tracks 363 in the direction of arrow "G" (FIG. 18) toward the ignitor trigger 316. Because the second end of cable 367 is connected to first leg 360*a* of trigger member 360 and the first end of cable 367 is connected to cog wheel 262, as the trigger member 360 slides toward the ignitor trigger 316 the cog wheel 362 is forced to rotate in the direction of arrow "H" (FIG. 19). The rotational motion of wheel 362 also causes return spring 369 to be wound. Since teeth 364 on wheel 362 are engaged with slider 330, the rotation of wheel 362 drives slider 330 toward front end 314*a* of barrel 314 and in the opposite direction to arrow "G". As is the case with slider 30, this movement of slider 330 causes first and second arms 334, 336 to be moved from a first retracted position (FIG. 18) to a second extended position (FIG. 19). The this second position the paddles 338, 340 are brought into contact with each other (FIG. 21. In this position, the paddles 338, 340 clamp the burning wick between them (not shown in FIG. 21), thus extinguishing the flame. It should also be noted that when trigger member 360 is engaged to extinguish a flame, the second leg 360*c* thereof extends into recessed region 317 to a degree sufficient to prevent ignitor trigger 316 from being activated.

Once the flame is extinguished, the user releases the trigger member 360. The return spring 369 reverts to its original condition and, as it does so, it causes cog wheel 362 to rotate in the opposite direction to arrow "H". This in turn causes slider 330 to be moved in the opposite direction to arrow "G" and thereby causes first and second arms 334, 336 to be returned to the retracted first position. Additionally, when trigger member 360 moves back to its at rest position, the second leg 316*c* thereof moves in recessed region 317 to a point where ignitor trigger 316 can once again be activated.

Referring to FIGS. 22-26 there is shown an ignitor extinguisher device 410 that includes a fourth embodiment of an extinguisher mechanism in accordance with the present invention and generally indicated at 420. Once again, device 410 includes the components that constitute an ignitor mechanism that is utilized in presently known barbeque lighters. These known components are numbered in FIGS. 22-26 as components 412-417 and are substantially identical in structure and function to components 12-17. Similarly, extinguisher mechanism 420 includes a snuffer apparatus 422 and an extinguisher trigger 424. The snuffer apparatus 422 is substantially identical in structure and function to snuffer apparatus 22.

In accordance with a specific feature of the invention, extinguisher trigger 424 includes a body 448 and a trigger member 460. Body 448 is substantially identical in structure and function to body 348 and is secured to housing 412 and barrel 414 in a substantially identical manner. Body 448 includes a pair of spaced apart flanges 458*a*, 458*b*. At least one of flanges 458*a*, 458*b* includes at least one 473 in a region near barrel 414. Preferably, at least one of flanges 458*a*, 458*b* also includes at least one track (not shown) in a region proximate a bottom end 458*c* (FIG. 26) of body. Any such tracks provided are substantially aligned with the longitudinal axis "Y" of barrel 414. A cog wheel 462 is mounted to flanges 458*a*, 458*b* by a pivot pin 465 that is oriented at right angles to the longitudinal axis of barrel 414 and extends between flanges 458*a*, 458*b*. A plurality of teeth 464 radiate outwardly from an outer surface 462*a* of cog wheel 462. Teeth 464 are designed to be received in apertures 432 in slider 430 in the same manner that teeth 64 are received in the apertures 32 in slider 30. A return spring 469 is secured at one end to one of flanges 458*a*, 458*b* and at a second end to cog wheel 462. Spring 469 biases extinguisher trigger 460 into the at rest position so that the snuffer apparatus 422 is in the retracted position.

In accordance with yet another specific feature of the present invention, at least one gear 481 is operationally linked to trigger member 460. Gear 481 may be integrally formed with cog wheel 462 or may be a separate component that is coaxially mounted on pivot pin 465. Gear 481 is designed to rotate about the axis of pivot pin 465 and therefore at right angles to the longitudinal axis "Y" of barrel 414. Gear 481 is provided with a plurality of gear teeth 483 that radiate outwardly from its outer surface. In the embodiment of the invention shown in FIGS. 22-26, a gear 481 is provided on each side of cog wheel 462, and each gear 481 includes a plurality of teeth 483.

Figure 23:
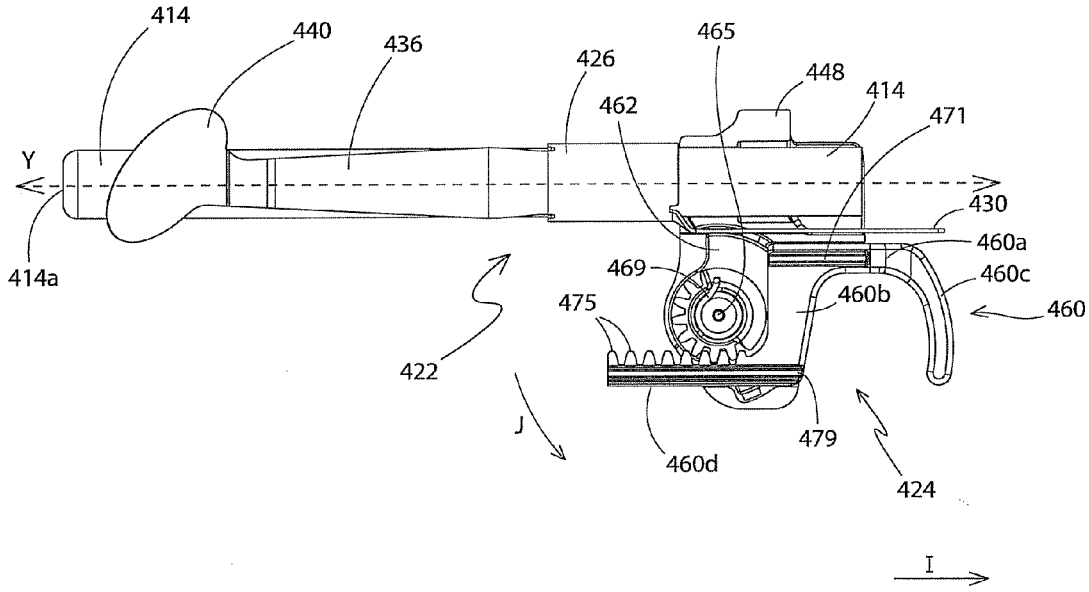
FIG. 23 is a partial left side view of the device of FIG. 22 with the extinguisher mechanism cover removed to reveal the gear operated extinguisher mechanism in the at rest position.
Figure 24:
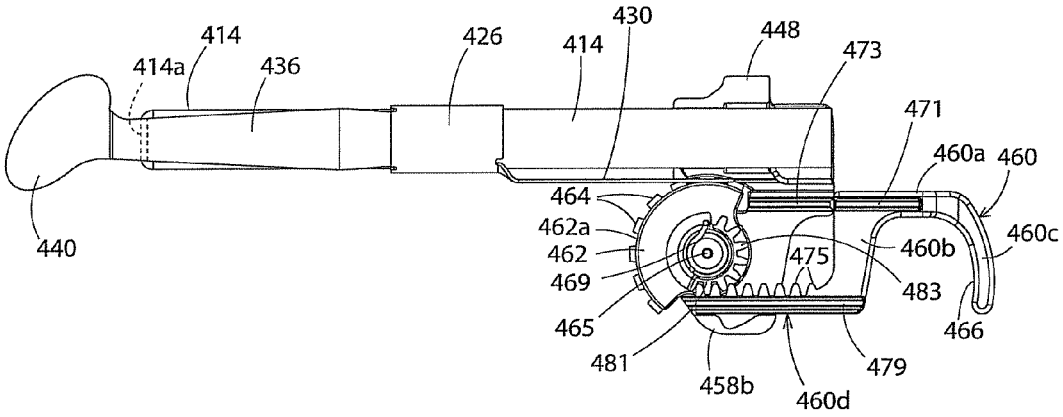
FIG. 24 is a partial left side view of the device of FIG. 22 with the extinguisher mechanism cover removed and showing the gear operated extinguisher mechanism in the activated position.
Figure 25:
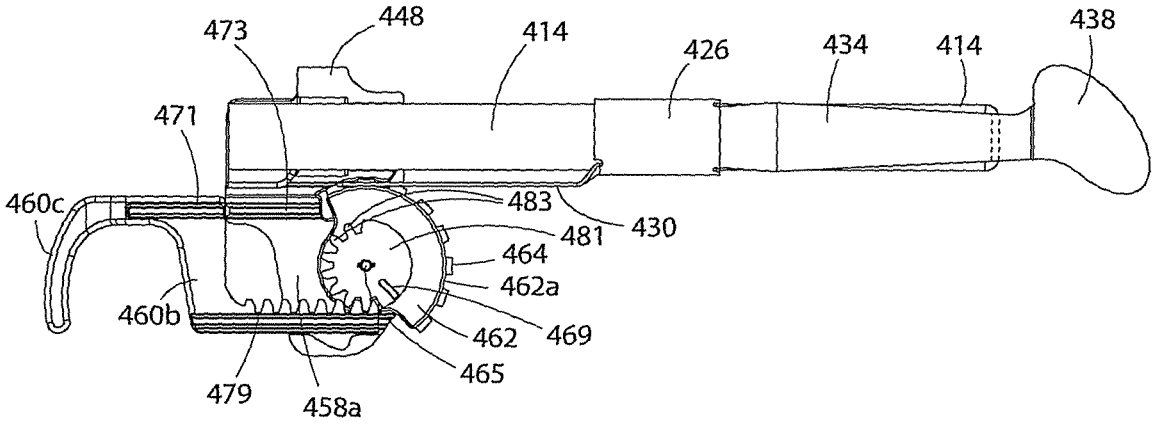
FIG. 25 is a partial right side view of the device of FIG. 24.
Figure 26:
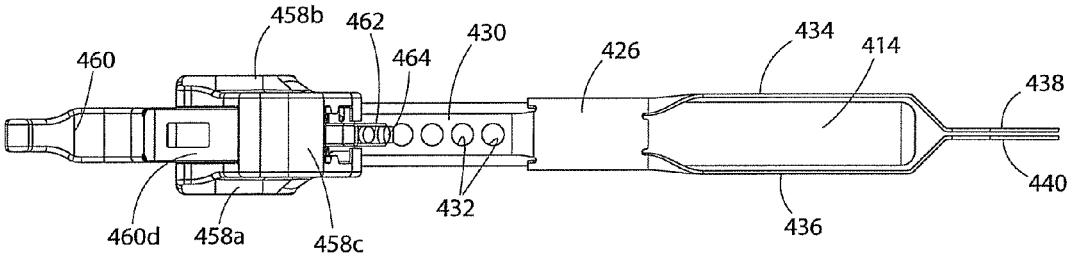
FIG. 26 is a partial bottom view of the device of FIG. 24.

Trigger member 460 includes a horizontal region 460*a* with a first leg 460*b* and a second leg 460*c* extending outwardly therefrom and generally at right angles thereto. First and second legs 460*b*, 460*c* extend outwardly from horizontal region 460*a* in the same direction. A rack 460*d* extends outwardly from one end of first leg 460*b* and in a direction away from second leg 460*c*. Horizontal region 460*a* is provided with at least one track 471 configured to interlockingly engage with the at least one track 473 on flanges 458*a*, 458*b*. Rack 460*d* preferably is also provided with at least one track 479 configured to engage the at least one track (not shown) proximate bottom end 458*c* of flanges 458*a*, 458*b*. The engagement between the tracks in horizontal region 460*a*, rack 460*d* and flanges 458*a*, 458*b* is such that trigger member 460 is able to slide easily between an at rest position (FIG. 23) and an activated position (FIG. 24).

In accordance with yet another specific feature of the present invention, second rack 460*d* includes at least one rack that is provided with a plurality of upstanding teeth 475 configured to interlockingly engage and mesh with teeth 483 of the at least one gear 481 on cog wheel 462. In the embodiment shown in FIGS. 22-26 a pair of spaced-apart racks are provided on rack 460*d*, each rack including a plurality of teeth 475 designed to mesh with the teeth 483 on the two gears 481 on cog wheel 462.

Device 410 is used in the same manner as described with respect to device 10 to light a candle. Device 410 is used to extinguish a candle flame in the following manner. Firstly, as with the previous embodiments of the invention, front end 414*a* of barrel 414 is brought into close proximity of a candle wick (as illustrated in FIG. 11). The user then positions their trigger finger on the finger rest 466 on the second leg 460*c* of trigger member 460 and depresses the same. This causes trigger member 460 to slide along tracks 473 on flanges 458*a*, 458*b* in the direction of arrow "I" (FIG. 23). As trigger member 460 moves in this direction, rack 460*d* is also moved linearly in the direction of arrow "I". The movement of region 460*d* causes gear 481 to rotate because the teeth 745 thereof are meshed with the gear teeth 483. Gear 481 is caused to rotate in the direction of arrow "J" (FIG. 23). Since gear 481 and cog wheel 462 are mounted on the same pivot pin 465, when gear 481 rotates in the direction of arrow "J", cog wheel 462 is also caused to rotate in the direction of arrow "J". This motion also causes return spring 469 to be wound up. The motion of cog wheel 462 also causes slider 430 to be moved in the opposite direction of arrow "I" because the teeth 464 of cog wheel 462 are engaged in apertures 432 in slider 430. Slider 430, in turn, pushes first and second arms 434, 436 along barrel 414 from the retracted first position to the second position where paddles 438, 440 extend beyond front end 414*a* of barrel 414. Paddles 438, 440 move toward each other as the relevant portion of first and second arms 434, 436 moves beyond front end 414*a* and the candle wick is clamped between paddles 438, 440 extinguishing the flame. Additionally, when trigger member 460 is in the activated position shown in FIG. 24, it should be noted that second leg 460*c* thereof extends well into the recessed region 417 in housing 412 and is positioned in such a location that ignition trigger 416 cannot be actuated.

When the user releases trigger member 460, the return spring 469 returns to its original condition and as it does so it rotates cog wheel 462 and gear 481 back to their original at rest positions. The rotation of cog wheel 462 causes slider 430 to be drawn back toward the first position and the paddles 438, 440 are retracted back to where they are disposed rearwardly of front end 414*a* of barrel 414. It should be noted that second leg 460*c* of trigger member 460 also moves forwardly out of the way of ignitor trigger 416 which may then be used once again to light a candle.

It should be noted that both of the third and fourth embodiments of the invention have an approximately 2:1 mechanical advantage in trigger movement to snuffer apparatus movement. Furthermore, the linear motion of the trigger in both of these embodiments also makes for a device that is compact and easily operated.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A device for lighting and extinguishing candles comprising:

a housing;

a chamber defined in the housing and adapted to retain a quantity of a flammable fuel therein;

an aperture defined in the housing, said aperture being in fluid communication with the chamber; and wherein the housing further includes:

a barrel extending outwardly therefrom;

a bore defined in the barrel and being in communication with the chamber in the housing; and wherein the aperture is provided at a terminal end of the barrel;

an ignitor mechanism provided on the housing and adapted to cause an ignition flame to extend outwardly from the aperture; and an extinguisher mechanism provided on the housing and being movable between a first position where the mechanism is retracted away from the aperture and a second position where the mechanism extends outwardly beyond the aperture; and wherein the extinguisher mechanism includes a snuffer apparatus comprising:

a pair of paddles extending outwardly from the housing in a first direction and being movable toward and away from each other; and, when in the first position, the paddles are disposed inwardly of the terminal end of the barrel; and when in the second position, the paddles extend outwardly beyond the terminal end of the barrel;

a slider that is aligned longitudinally with the barrel, said slider being movable in a first direction toward the terminal end of the barrel and being movable in a second direction away from the terminal end of the barrel; and a sleeve defining a bore through which the barrel is received; said sleeve being movable along the barrel between the first and second positions; and wherein the slider extends outwardly from the sleeve in the opposite direction to the paddles.

2. The device as defined in claim 1, wherein the paddles move toward each other when the extinguisher mechanism is moved from the first position to the second position and move away from each other when the extinguisher mechanism is moved from the second position to the first position.

3. The device as defined in claim 2, wherein the paddles extend outwardly beyond the aperture and abut each other when the extinguisher mechanism is in the second position, and the paddles are retracted away from the aperture and are spaced from each other when the extinguisher mechanism is in the first position.

4. The device as defined in claim 2, wherein the extinguisher mechanism further comprises an extinguisher actuator that is operationally connected to the snuffer apparatus and is movable between an at rest position and an activated position, and when the actuator is in the at rest position the extinguisher mechanism is in the first position, and when the actuator is in the activated position the extinguisher mechanism is in the second position.

5. The device as defined in claim 4, wherein the extinguisher actuator includes a trigger member.

6. The device as defined in claim 5, wherein the trigger member is rotated to actuate the snuffer apparatus.

7. The device as defined in claim 5, wherein the extinguisher mechanism further includes a return spring which biases the extinguisher trigger into the at rest position.

8. The device as defined in claim 1, wherein the pair of paddles extend outwardly from the sleeve.

9. The device as defined in claim 1, wherein the paddles are spring-biased toward each other.

10. The device as defined in claim 1, wherein the extinguisher mechanism further comprises an extinguisher trigger operationally connected to the slider, and the extinguisher trigger is movable between an at rest position and an actuated position, and when the extinguisher trigger moved from the at rest position to the actuated position the slider is moved in the first direction and the paddles extend beyond the terminal end; and when the extinguisher trigger is moved from the actuated position to the at rest position the slider is moved in the second direction and the paddles are retracted inwardly from the terminal end.

11. The device as defined in claim 1, wherein the paddles are vertically oriented when in the second position and are adapted to clamp a burning wick there between.

12. The device as defined in claim 1, wherein the paddles each include at least one lobe positioned diagonally relative to the longitudinal axis of the barrel, and wherein the lobe extends one of above and below the upper and lower surfaces of the barrel respectively.

13. The device as defined in claim 1, wherein the extinguisher mechanism further includes a return spring engaged with the snuffer apparatus; and wherein the return spring biases the snuffer apparatus into the first position.

14. The device as defined in claim 1, wherein the snuffer apparatus includes a pair of arms, each arm having one of the pair of paddles disposed thereon; and wherein each arm includes:

a first face engaged at a first end with a portion of the housing;

a second face extending outwardly from a second end of the first face; and a third face extending outwardly from an end of the second face and disposed at a first angle relative thereto; and wherein the one of the pair of paddles extends outwardly from an end of the third face and at a second angle relative thereto; and the first and second angles are such that when the snuffer apparatus is in the first position, the paddles thereof diverge away from each other; and when the snuffer apparatus is in the second position, the paddles thereof are disposed adjacent and substantially parallel to each other.

15. A device for lighting and extinguishing candles comprising:

a housing;

a chamber defined in the housing and adapted to retain a quantity of a flammable fuel therein;

an aperture defined in the housing and being in fluid communication with the chamber, an ignitor mechanism provided on the housing and adapted to cause an ignition flame to extend outwardly from the aperture; and an extinguisher mechanism provided on the housing and being movable between a first position where the mechanism is retracted away from the aperture and a second position where the mechanism extends outwardly beyond the aperture; wherein the housing includes:

a barrel extending outwardly therefrom;

a bore defined in the barrel and communicating with the chamber in the housing; the aperture being provided at a terminal end of the barrel;

and wherein the extinguisher mechanism includes a snuffer apparatus comprising:

a pair of paddles extending outwardly from the housing in a first direction and being movable toward and away from each other; and when in the first position, the paddles are disposed inwardly of the terminal end of the barrel; and when in the second position, the paddles extend outwardly beyond the terminal end of the barrel; and wherein the extinguisher mechanism includes and extinguisher trigger; and wherein the ignitor mechanism further includes an igniter trigger that is separately operable to the extinguisher trigger; and, wherein the extinguisher trigger physically obstructs the igniter trigger when the extinguisher trigger is in the activated position.

16. A device for lighting and extinguishing candles comprising:

a housing;

a chamber defined in the housing and adapted to retain a quantity of a flammable fuel therein;

an aperture defined in the housing and being in fluid communication with the chamber, an ignitor mechanism provided on the housing and adapted to cause an ignition flame to extend outwardly from the aperture; and an extinguisher mechanism provided on the housing and being movable between a first position where the mechanism is retracted away from the aperture and a second position where the mechanism extends outwardly beyond the aperture;

wherein the housing includes:

a barrel extending outwardly therefrom;

a bore defined in the barrel and communicating with the chamber in the housing; the aperture being provided at a terminal end of the barrel;

and wherein the extinguisher mechanism includes a snuffer apparatus comprising:

a pair of paddles extending outwardly from the housing in a first direction and being movable toward and away from each other; and when in the first position, the paddles are disposed inwardly of the terminal end of the barrel; and when in the second position, the paddles extend outwardly beyond the terminal end of the barrel;

a slider that is aligned longitudinally with the barrel and is movable in a first direction toward the terminal end of the barrel and is movable in a second direction away from the terminal end of the barrel; wherein the slider defines a plurality of apertures therein spaced at intervals from each other; and the extinguisher mechanism includes an extinguisher trigger which includes:

a cog wheel pivotally mounted to rotate about an axis disposed at right angles to the longitudinal axis of the barrel; and a plurality of teeth extending radially outwardly from the cog wheel, said teeth progressively engaging in the apertures in the slider as the cog wheel rotates; and wherein rotation of the cog wheel in a first direction causes the slider to move toward the terminal end of the barrel, and rotation of the cog wheel in a second direction causes the slider to move away from the terminal end of the barrel.

* * * * *